US005354948A

United States Patent [19]

Toda

[11] Patent Number: 5,354,948

[45] Date of Patent: Oct. 11, 1994

[54] TONE SIGNAL GENERATION DEVICE FOR GENERATING COMPLEX TONES BY COMBINING DIFFERENT TONE SOURCES

[75] Inventor: Hiroyuki Toda, Hamamatsu, Japan

[73] Assignee: Yamaha Corporation, Japan

[21] Appl. No.: 591,840

[22] Filed: Oct. 2, 1990

[30] Foreign Application Priority Data

Oct. 4, 1989 [JP] Japan ..... 1-259414
Oct. 4, 1989 [JP] Japan ..... 1-259415
Oct. 4, 1989 [JP] Japan ..... 1-259416

[51] Int. Cl.[5] ..... G10H 7/00; G10H 1/04

[52] U.S. Cl. ..... 84/624; 811/625; 811/626

[58] Field of Search ..... 84/624, 625, 659, 660, 84/622, 626, 694–697

[56] References Cited

U.S. PATENT DOCUMENTS

| | | | |
|---|---|---|---|
| 3,000,252 | 9/1961 | Wayne | 84/697 X |
| 3,532,799 | 10/1970 | Kameoka et al. | 84/695 X |
| 4,131,049 | 12/1978 | Okamura et al. . | |
| 4,173,164 | 11/1979 | Adachi et al. | 84/695 |
| 4,174,650 | 11/1979 | Hiyoshi et al. . | |
| 4,175,463 | 11/1979 | Deutsch | 84/659 X |
| 4,788,896 | 12/1988 | Uchiyama et al. | 84/624 |
| 4,922,796 | 5/1990 | Kondo et al. | 84/622 X |
| 4,924,744 | 5/1990 | Yamamura | 84/601 |
| 4,957,552 | 9/1990 | Iwase | 84/622 |
| 5,094,136 | 3/1992 | Kudo et al. | 84/603 |
| 5,119,710 | 6/1992 | Tsurumi et al. | 84/615 |

*Primary Examiner*—William M. Shoop, Jr.
*Assistant Examiner*—Jeffrey W. Donels
*Attorney, Agent, or Firm*—Graham & James

[57] ABSTRACT

Two tone sources having different tone generation systems such as an FM tone source and a PCM tone source are provided. Tone signals are generated in the two tone sources in response to tone generation designation information such as keyboard performance information. One of the tone sources synthesizes a tone by employing a modulation operation such as FM or AM and, as a modulating signal supplied thereto, an output tone signal of the other tone source can be selectively used. A single complex tone color is constructed of plural element tone colors and which tone source should generate a partial tone signal corresponding to each element tone color can be designated individually with respect to each element tone color in response to element type information. With respect to a desired element tone color, editing of contents of its parameter information can be made as desired. In data editing, data of a desired complex tone color is transferred to an edit memory section and editing is applied to data stored therein. The number of tone signals to be generated simultaneously in response to common tone generation designation information can be set as desired and generated tone signals are added and synthesized to form a single tone signal. In this manner, a more complex and diversified tone can be formed as desired.

16 Claims, 19 Drawing Sheets

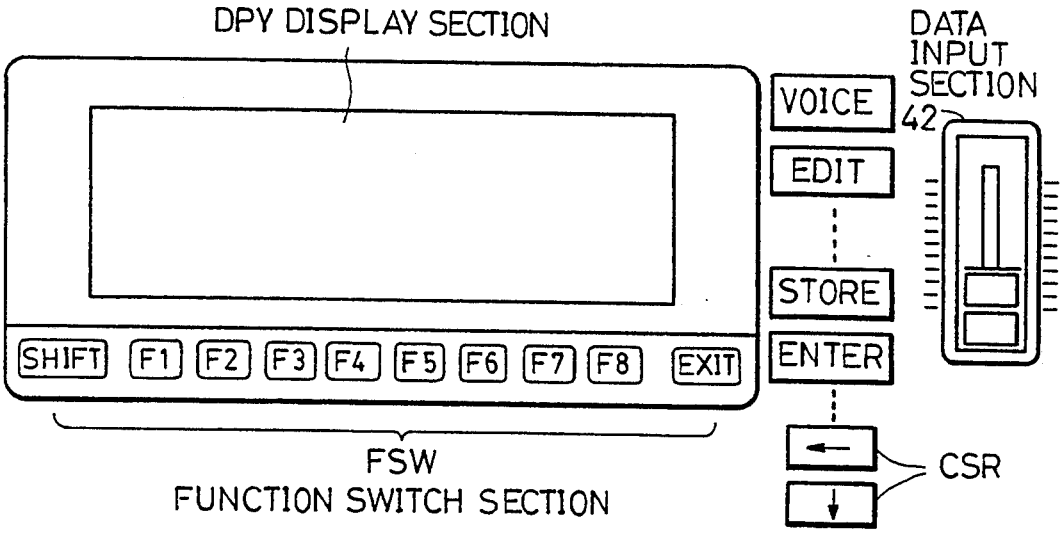

FIG. 7

VN ··· VOICE NUMBER
VOICEP ··· VOICE DATA POINTER
VMODE ··· VOICE MODE
NSCH ··· SIMULTANEOUSLY SOUNDABLE TONE NUMBER REGISTER
ESP(1) ~ ESP (4) ··· ELEMENT START POINTER
EDS(1) ~ EDS (4) ··· EDIT START POINTER
FSWBUF ··· FUNCTION SWITCH BUFFER
EMODE ··· EDIT MODE
EPBUF ··· ENTRY POINT BUFFER
ETBUF ··· ELEMENT TYPE BUFFER
PAGEBUF ··· PAGE BUFFER
PAGE ··· CURRENT PAGE
STVN ··· STORE VOICE NUMBER
STVP ··· STORE VOICE POINTER
KCODE ··· KEY CODE
TDATA ··· TOUCH DATA
ASCH ··· PRIMARY ASSIGNMENT CHANNEL
CHBUF ··· CHANNEL BUFFER

FIG. 10

ELEMENT TYPE TABLE ETT

| VOICE MODE (VMODE) | ELEMENT 1 | ELEMENT 2 | ELEMENT 3 | ELEMENT 4 | SIMUL. SOUNDABLE TONE NO. (NSCH) |
|---|---|---|---|---|---|
| 1 | 1 (FM) | 0 | 0 | 0 | 1 |
| 2 | 1 (FM) | 1 (FM) | 0 | 0 | 1 |
| 3 | 1 (FM) | 1 (FM) | 1 (FM) | 1 (FM) | 1 |
| 4 | 1 (FM) | 0 | 0 | 0 | 16 |
| 5 | 1 (FM) | 1 (FM) | 0 | 0 | 8 |
| 6 | 2 (PCM) | 0 | 0 | 0 | 16 |
| 7 | 2 (PCM) | 2 (PCM) | 0 | 0 | 8 |
| 8 | 2 (PCM) | 2 (PCM) | 2 (PCM) | 2 (PCM) | 4 |
| 9 | 1 (FM) | 2 (PCM) | 0 | 0 | 16 |
| 10 | 1 (FM) | 1 (FM) | 2 (PCM) | 2 (PCM) | 8 |

FIG. 9

ENTRY POINT TABLE EPT

| PAGE | VOICE SELECTION 1 | --- | VOICE MODE SELECTION nE1 | COMMON DATA EDIT nE+1 | FM DATA EDIT MENU nE+2 | PCM DATA EDIT MENU nE+3 | --- | STORE nS | STORE END nS+1 | --- |
|---|---|---|---|---|---|---|---|---|---|---|
| VOICE KEY-ON | NoEP | | EPV | EPV | EPV | EPV | | NoEP | EPV | |
| ED KEY-ON | EPED | | NoEP | NoEP | NoEP | NoEP | | NoEP | NoEP | |
| ⋮ | | | | | | | | | | |
| F1 KEY-ON | | | NoEP | EPVM | EPVM | EPVM | | QUIT | QUIT | |
| F2 KEY-ON | | | EPCOM | NoEP | EPCOM | EPCOM | | NoEP | NoEP | |
| F3 KEY-ON | | | EPE1 | EPE1 | EPE1 | EPE1 | | NoEP | NoEP | |
| ⋮ | | | | | | | | | | |
| CSR KEY-ON | EPCD (1) | | EPCD (nE) | EPCD (nE+1) | EPCD (nE+2) | EPCD (nE+3) | | EPCD (nS) | NoEP | |
| ⋮ | | | | | | | | | | |
| DATA INPUT SECTION CHANGE PRESENT | EPDS(1) | | EPDS (nE) | EPDS (nE+1) | EPDS (nE+2) | EPDS (nE+3) | | EPDS (nS) | NoEP | |
| ⋮ | | | | | | | | | | |
| STORE KEY-ON | NoEP | | EPST | EPST | EPST | EPST | | NoEP | EPST | |
| ⋮ | | | | | | | | | | |
| ENTER KEY-ON | NoEP | | | EPET (nE+1) | EPET (nE+2) | EPET (nE+3) | | NoEP | NoEP | |
| ⋮ | | | | | | | | | | |

FIG. 11

Voice Directory
INTERNAL-BANK B (17-32 )

02

| | | | |
|---|---|---|---|
| 01 AC Pia | 05 MAGIC | 09 METAL | 13 ELEPIN |
| 02 YAMSP | 06 Dream | 10 KOYAMA | 14 Power |
| 03 PHON | 07 Super | 11 H.SIL | 15 EOS pf |
| 04 M1 PF | 08 NPOP | 12 SHAKE | 16 PCM pf |

```
VOICE EDIT        E1 FM  E3 PCM
                  E2 FM  E4 PCM
:1 -B02(18) YAMSP ELEP
                                        10
01 1EM mono 05 2FM  poly   09 1FM&1PCM pl
02 2FM mono 06 1PCM poly   [10 2FM&2PCM pl]
03 4FM mono 07 2PCM poly
04 1FM poly 08 4PCM poly
MODE [COM] [E1] [E2] [E3] [E4]
```

FIG. 28

```
VOICE EDIT        E1 FM  E3 ——
                  E2 PCM E4 ——
:1 -B02(18) YAMSP ELEP
                                        01
[01 E1 Lvl] 05 Output 09 Mi Tne  13 ——
02 E1 Dtn   06 Random 10 Cntrol  14 ——
03 E1 Nte   07 Portam 11 Name    15 INIT
04 E1 Pan   08 Effect 12 ——      16 RECALL
[MODE] COM [E1] [E2]
```

FIG. 29

```
VOICE EDIT        E1 FM  E3 ——
                  E2 PCM E4 ——
:1 -B02(18) YAMSP ELEP
                                        01
[01 Algo]   05 Op Sns 09 FBPCL  13 ——
02 Op Osc   06 LFO    10 ——     14 ——
03 Op EG    07 Pch EG 11 ——     15 INIT
04 Op Out   08 Filter 12 ——     16 RECALL
[MODE] [COM] E1 [E2]
```

FIG. 30

```
VOICE EDIT          E1 FM  E3 ——
                    E2 PCM E4 ——
:1 -B02(18) YAMSP ELEP
                                        01
[01 Wave]  05 LFO     09 ———  13 ———
02 AmpEG   06 Pch     10 ———  14 ———
03 Output  07 Filter  11 ———  15 INIT
04 Sens    08 ———     12 ———  16 RECALL
[MODE] [COM]  E1  [E2]
```

FIG. 31

```
FM Feedback & PCM Lavel Edit
VOICE:   YAMSP ELEP (E1/FM)
         FEEDBACK INPUT = OP-4
```

| | OP1 | OP2 | OP3 | OP4 | OP5 | OP6 |
|---|---|---|---|---|---|---|
| FB Lavel | 50 | 3 | 0 | 0 | 10 | 15 |
| PCM Lavel | 10 | 5 | 8 | [20] | 4 | 0 |

[ALG]

FIG. 32

```
Store  Voice
:1 -B02(18) YAMSP ELEP
INTERNAL BANK B

01 AC Pia   05 MAGIC    09 METAL    13 ELEPIN
02 YAMSP    06 Dream    10 KOYAMA   14 Power
03 PHON     [07 Super]  11 H.SIL    15 EOS pf
04 M1 PF    08 NPOP     12 SHAKE    16 PCM pf
[QUIT]                              [STRT]
```

FIG. 33

TONE SIGNAL GENERATION DEVICE FOR GENERATING COMPLEX TONES BY COMBINING DIFFERENT TONE SOURCES

BACKGROUND OF THE INVENTION

This invention relates to a tone signal generation device used in an electronic musical instrument or a tone source module and, more particularly, to a tone signal generation device having plural tone sources and having at least one tone source of a tone source system using a modulation operation and being capable of utilizing an output of other tone source as a modulating signal in the tone source of the tone source system using a modulation operation and also sounding this output as a tone.

This invention relates also to a tone signal generation device having plural tone sources of different tone generation systems and generating a tone signal by assigning to the respective tone sources partial tone signals corresponding to element tone colors which are combined together to form one complex tone color.

Further, this invention relates to a tone signal generation device having plural tone sources of different tone generation systems and being capable of freely selecting a combination of tone sources used for tone generation.

Japanese Patent Application Laid-open No. 61-29895 discloses a tone signal generation device using a self-feedback type modulation operation which has a memory storing a waveform of plural periods sampled from, e.g., a natural musical instrument tone and in which a waveform signal is read from the memory by a phase address signal corresponding to a frequency of a desired tone pitch, the output of this memory is fed back to the address input side to modulate the phase address signal corresponding to a frequency of a desired tone pitch and the output of this memory is provided as a tone signal.

Japanese Patent Application Laid-open No. 61-39097 discloses a tone signal generation device of a frequency modulation (hereinafter referred to as FM) operation type which has a memory (as it were a PCM tone source) storing a waveform of plural periods sampled from, e.g., a natural musical instrument tone and in which the output of this memory is used as a modulating wave signal or this memory is used for generating a carrier signal.

These prior art tone generation devices can be said to have two tone sources of a PCM tone source and an FM tone source and use a waveform signal generated in the PCM tone source as a modulating signal for the FM tone source.

In the above described prior art tone generation device, the PCM tone source is substantially included in the FM tone source and cannot be used effectively as an independent tone source. In other words, the prior art devices have the PCM tone source but cannot use it for other purposes than as a modulating signal or a carrier signal. For this reason, the tone color of a tone which can be synthesized is limited to one having a characteristic of the FM tone source and hence limitation is imposed upon forming of a tone.

Japanese Patent Application Laid-open No. 59-168493 discloses an electronic musical instrument which includes a quasi-PCM tone source using a memory storing a waveform of plural periods sampled from a natural muscial instrument and generating a tone signal by reading the waveform from the memory, and a quasi-waveform operation system tone source generating a tone signal by executing a waveform operation such as an FM operation, and synthesizes a final tone signal adding waveform signals generated from the two tone sources in response to depression of a key. This prior art electronic musical instrument, however, is limited in its forming of a tone because it merely adds and synthesizes two tone wave,form signals generated in two different tone sources.

SUMMARY OF THE INVENTION

It is an object of the invention to provide a tone signal generation device which has plural tone sources and at least one tone source of a tone source system using a modulation operation and is capable of utilizing an output of other tone source as a modulating signal for the tone source using a modulation operation and also sounding this output as a tone whereby forming of a complicated tone peculiar to the tone source by the modulation operation made more complex and is diversified by introduction of the output of the other tone source as a modulating signal and, on the other hand, forming of a tone peculiar to the other tone source is made possible and, as a result, the range of forming a tone in the entire device is broadened and forming of a more complex and diversified tone is realized.

It is another object of the invention to provide a tone signal generation device having plural tone sources of different tone generation systems which generates a tone signal by assigning, to the respective tone sources, generation of a partial tone signal corresponding to each of element tone colors which are combined together to constitute a complex tone color whereby the range of forming of a tone is broadened and forming of a more complex and diversified tone is made possible. It is also an object of the invention to facilitate editing of tone color data such as change or setting.

The tone signal generation device achieving one of the objects of the invention comprises a first tone source section for generating a tone signal in response to tone generation designation information, a second tone source section for generating a tone signal by executing a predetermined modulation operation in response to tone generation designation information, a modulating signal introduction control section for controlling introduction of an output tone signal of the first tone source section to a modulating signal input of the second tone source section, and a tone generation control section for performing a control for simultaneously generating the output tone signals of the first and second tone source sections.

By the modulating signal introduction control section, a control for introducing the output tone signal of the first tone source section to the modulating signal input of the second tone source section can be performed. By this control, the output tone signal of the first tone source section can be used as a modulating signal as required and the range of forming a tone by the modulation operation can be broadened.

Moreover, by the tone generation control section, a control for simultaneously generating the output tone signals of the first and second tone source sections can be performed. A diversified and wide-range tone forming can thereby be realized by suitably combining the outputs of the two tone source sections ranging from a tone color peculiar to the first tone source section to a tone color peculiar to the second tone source section.

The tone signal generation device achieving the other object of the invention comprises plural tone source sections for forming tone signals by tone generation systems which are different from one another, a tone color parameter generation section for generating at least element type information designating, with respect to each of element tone colors which are combined together to form a complex tone color, which tone source section should generate a partial tone signal corresponding to each of the element tone colors, and parameter information for each of the element tone colors, and a distribution section for distributing, responsive to the element type information for each element tone color, the parameter information corresponding to the element tone color to the tone source section designated by the element type information, the respective tone source sections generating partial tone signals each having an element tone color corresponding to the distributed parameter information and a tone signal corresponding to the complex tone color being generated by combining these partial tone signals.

The tone signal generation device further comprises an edit designation section designating change or setting of contents of the parameter information with respect to one of the element tone colors of the single complex tone color, and an edit control section for controlling, responsive to the element type information concerning the element tone color designated by the edit designation section, change or setting of contents of the parameter information adapted to the tone generation system of the respective tone source sections.

The tone color parameter generation section comprises a data memory which stores tone color data containing the parameter information and the element type information for each of a plurality of the complex tone colors, and the tone signal generation device further comprises an edit designation section for selecting one of the complex tone colors and designating change or setting of contents of the tone color data of the selected complex tone color, an edit memory section for reading the tone color data concerning the complex tone color designated by the edit designation section from the data memory and storing the tone color data, and an edit execution section for applying change of setting to the tone color data stored in the edit memory section.

A single complex tone color can be composed of plural element tone colors and which tone source section should generate a partial tone signal corresponding to each of the element tune colors can be individually designated by the element type information. Therefore, a single complex tone color can be formed by actively utilizing tone source sections made of different tone source systems in various combinations whereby the range of tone forming can be broadened and forming of a more complex and diversified tone can be realized.

Change or setting of contents of the parameter information with respect to one of the element tone colors of the single complex tone color can be designated and an automatic control is made so that, responsive to the element type information concerning the designated element tone color, change or setting of contents of the parameter information adapted to the tone generation system of the respective tone source sections can be made. Therefore, in editing tone color data, it is not necessary to designate each time which element tone color should be made by which tone source system, so that the editing work can be made more effectively.

Tone color data of a desired single complex tone color about which editing should be made is stored from the data memory to the edit memory section and data editing such as change and setting is applied to the one color data stored in the edit memory section. This enables the device to cope with increase in the data amount by providing a spare memory capacity in the edit memory section, so that degree of freedom in data editing is improved.

The tone signal generation device achieving the other object of the invention comprises a first tone source section capable of generating tone signals in N channels, a second tone source section capable of generating tone signals in M channels, the second tone source section having a tone generation system different from a tone generation system of the first tone source section, a tone source-system number combination information generation section for generating tone source-system number combination information consisting of information specifying respectively number "a" of in tone signals to be generated simultaneously in correspondence to common tone generation designation information in the first tone source sections and number "b" of tone signals to be generated simultaneously in correspondence to the common tone generation designation information in the second tone source section, and an assigning section responsive to tone generation designation information and the tone source-system number combination information for assigning generation of tone signals corresponding to the tone generation designation information to the "a" channels among the N channels in the first tone source section and assigning generation of tone signals corresponding to the tone generation designation information to the "b" channels among the M channels in the second tone source section, tone signals being generated in the respective channels of the respective tone source sections in accordance with these assignments.

The first tone source section is made of a tone generation system which is different from that of the second tone source section. If, for example, one is a PCM tone source system, the other is an FM tone source system. The respective tone source sections have their proper tone generation channels N and M. The relation between them may be that N is either equal or not equal to M.

The tone source-system number combination information generation section generates tone source-system number combination information consisting of information specifying respectively number "a" of tone signals (i.e., system number) to be generated simultaneously in correspondence to common tone generation designation information in the first tone source section and number "b" of tone signals (i.e., system number) to be generated simultaneously in correspondence to the common tone generation designation information in the second tone source section.

Any manner may be adopted for specifying "a" and "b" in the tone source-system number combination information. For example, the numerical values "a" and "b" may be directly designated or the numerical values "a" and "b" may be specified indirectly by designating one mode among plural modes corresponding to various combinations of the numbers "a" and "b". Alternatively, combinations of "a" and "b" may be prepared in correspondence to various selectable tone colors and predetermined "a" and "b" may be specified in correspondence to the selected tone colors.

The number "a" may be or may not be equal to "b". The number "a" or "b" may be 0 or 1 or 2 or a larger number. The number "a" or "b" however cannot exceed the largest channel number N and M of the respective tone source sections. When, for example, a=0, the number of tone signal to be generated in the first tone source section in response to the tone generation designation information is 0, i.e., this first tone source section is not used. When a=1, the number of tone signal to be generated in the first tone source section in response to the tone generation designation information is 1, i.e., the system number is 1. When a=2 or more, the number of tone signals to be generated in the first tone source section in response to common tone generation designation information is 2 or more, i.e., tone signals are generated in plural channels.

The tone generation designation information herein means information designating generation of a tone signal to the tone signal generation device and typically is tone pitch designation information provided in response to depression of a key in the keyboard. The tone generation designation information however is not limited to the tone pitch designation information but, when a tone such as a rhythm tone for which designation of tone pitch is not necessary is generated, this information may be one designating only a tone generation timing.

In response to the tone generation designation information and the tone source-system number combination information, the assigning section assigns generation of tone signals corresponding to the tone generation designation information to the "a" channels among the N channels in the first tone source section and assigns generation of tone signals corresponding to the "b" channels among the M channels in the second tone source section. Tone signals are generated in the respective channels of the respective tone source sections in accordance with these assignments.

Accordingly, by setting the numbers "a" and "b" to desired values and designating tone generation by depressing a certain key to designate a desired tone pitch, generation of a tone signal corresponding to the depressed key is assigned to "a" channels among N channels of the first tone source section and also assigned to "b" channels among M channels of the second tone source section. Tone signals corresponding to the depressed key are generated in "a" channels in the first tone source section and in "b" channels in the second tone source section. The tone signals generated in the first tone source section and those generated in the second tone source section may be added together and a tone signal corresponding to the single depressed key may thereby be finally produced. In other words, the final tone signal is a composite signal of partial tone signals (i.e., elements) having "a" characteristics generated in the first tone source section and partial tone signals (i.e., elements) having "b" characteristics generated in the second tone source section.

The element numbers in the respective tone source sections, i.e., "a" and "b", can be freely set or designated. The assigning section performs a suitable assigning processing each time in response to "a" and "b". Typically, the simultaneously soundable tone numbers corresponding to different tone generation designation information in the respective tone source sections vary in response to variation in "a" and "b". Generally, a quotient obtained by dividing the channel number N by "a" and a quotient obtained by dividing the channel number M by "b" are determined as simultaneously soundable tone numbers corresponding to the different tone generation designation information in the respective tone source sections and the assignment is made on the basis of these determined simultaneously soundable tone numbers. For example, when plural tones are to be generated with N=16 and a=4, assignment is made as a polyphonic musical instrument of maximum four tones. If the value of "a" changes, the polyphonic number also changes and assignment is made on the basis of this changed value of "a".

In the foregoing manner, by adopting the construction in which tone source-system number combination information consisting of information specifying respectively number "a" of tone signals to be generated simultaneously in correspondence to common tone generation designation information in the first tone source section and number "b" of tone signals to be generated simultaneously in correspondence to the common tone generation designation information in the second tone source section, these numbers "a" and "b" can be freely designated. Moreover, by enabling a proper assigning processing to be made in accordance with such freely designated numbers "a" and "b", two different tone sources can be actively utilized in various combinations and forming of a complex and diversified tone can be realized.

Embodiments of the invention will be described below with reference to the accompanying drawings.

BRIEF DESCRIPTION OF THE DRAWINGS

In the accompanying drawings,

FIG. 7 is a diagram showing an example of a display section and switches in the operation panel of FIG. 2;

FIG. 9 is a diagram showing contents of an element type table;

FIG. 10 is a diagram showing various registers used in this embodiment;

FIG. 11 is a diagram showing contents of an entry point table;

FIGS. 13 to 26 are flow charts showing examples of subroutines and switch ON event routine executed in the process of the main routine of FIG. 12; and FIGS. 27 to 33 are diagrams showing examples of pictures displayed in the display section of FIGS. 2 and 7.

DETAILED DESCRIPTION OF PREFERRED EMBODIMENTS

Figure 1A:
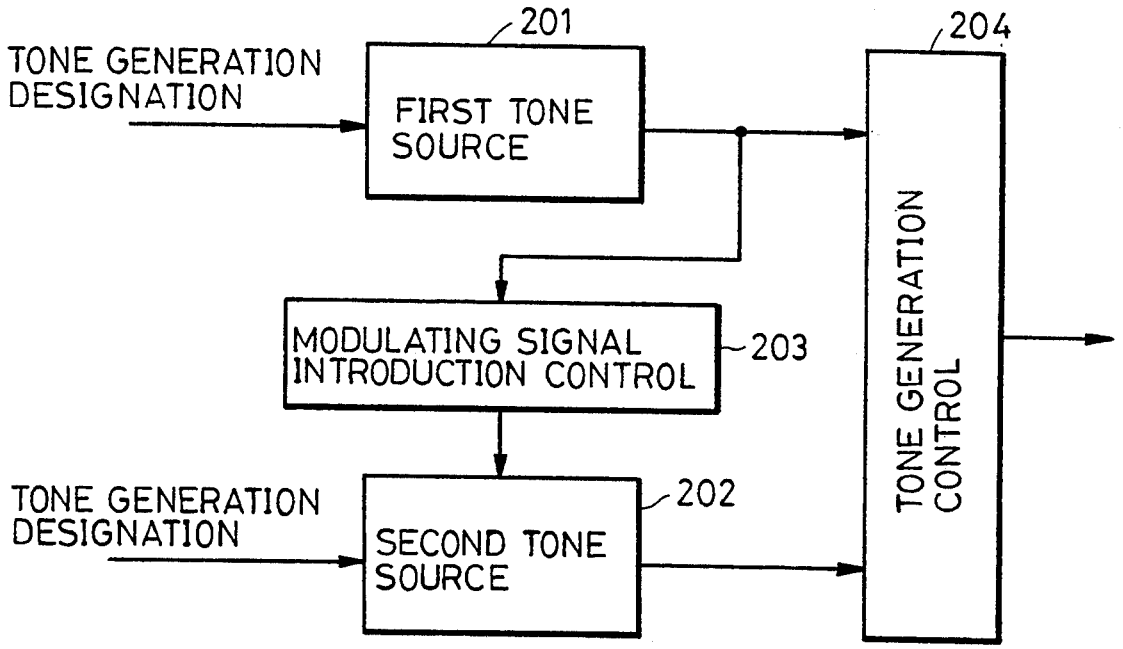
FIGS. 1A to 1E are functional block diagrams showing the outline of the invention.
Figure 1E:
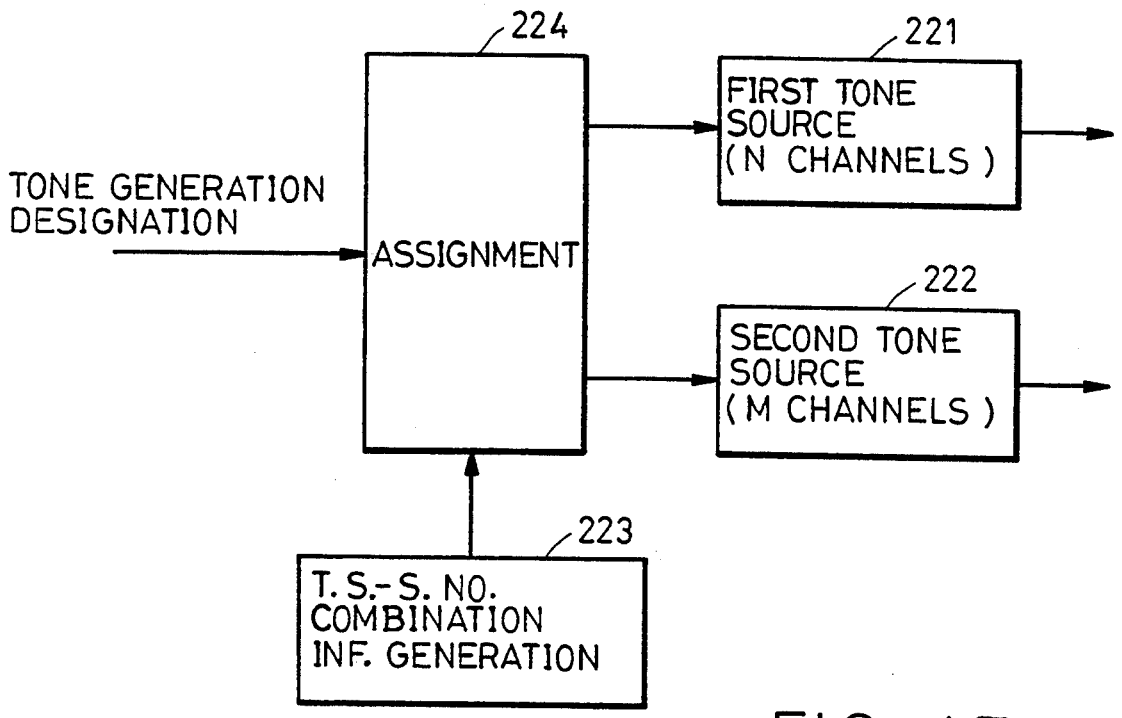
Figure 1B:
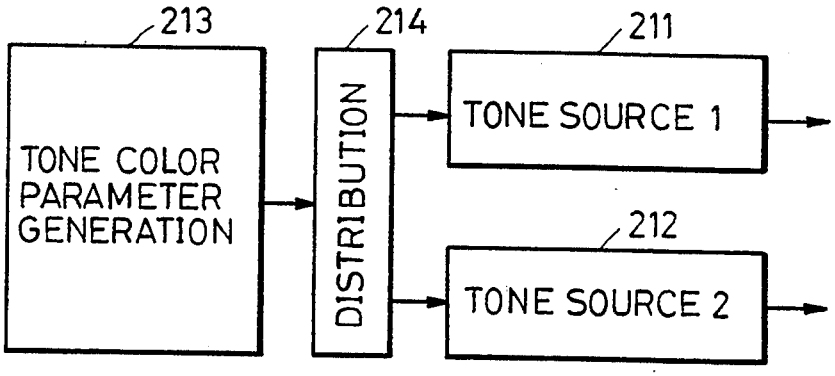
Figure 1C:
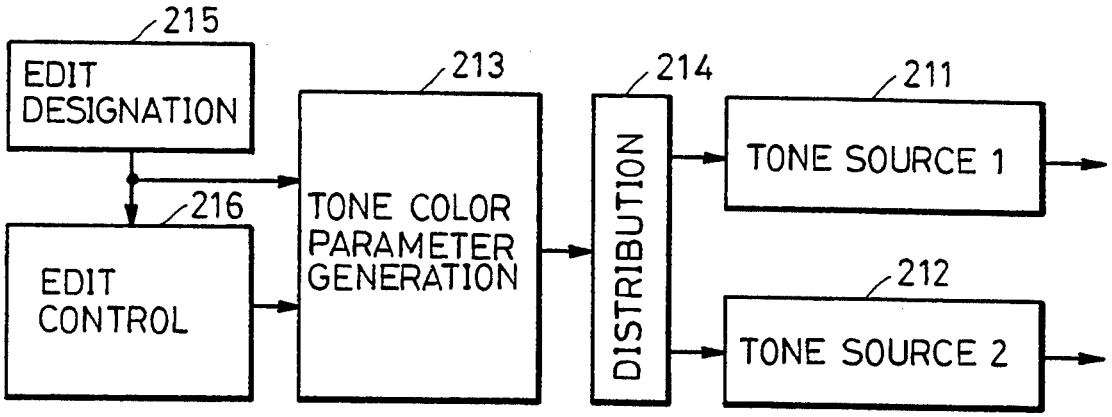
Figure 1D:
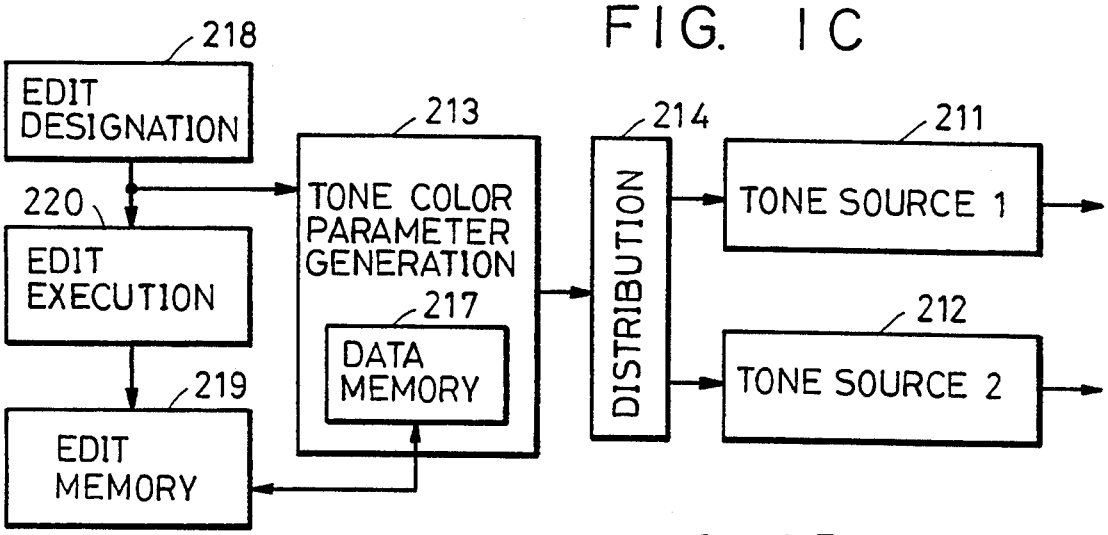
Figure 2:
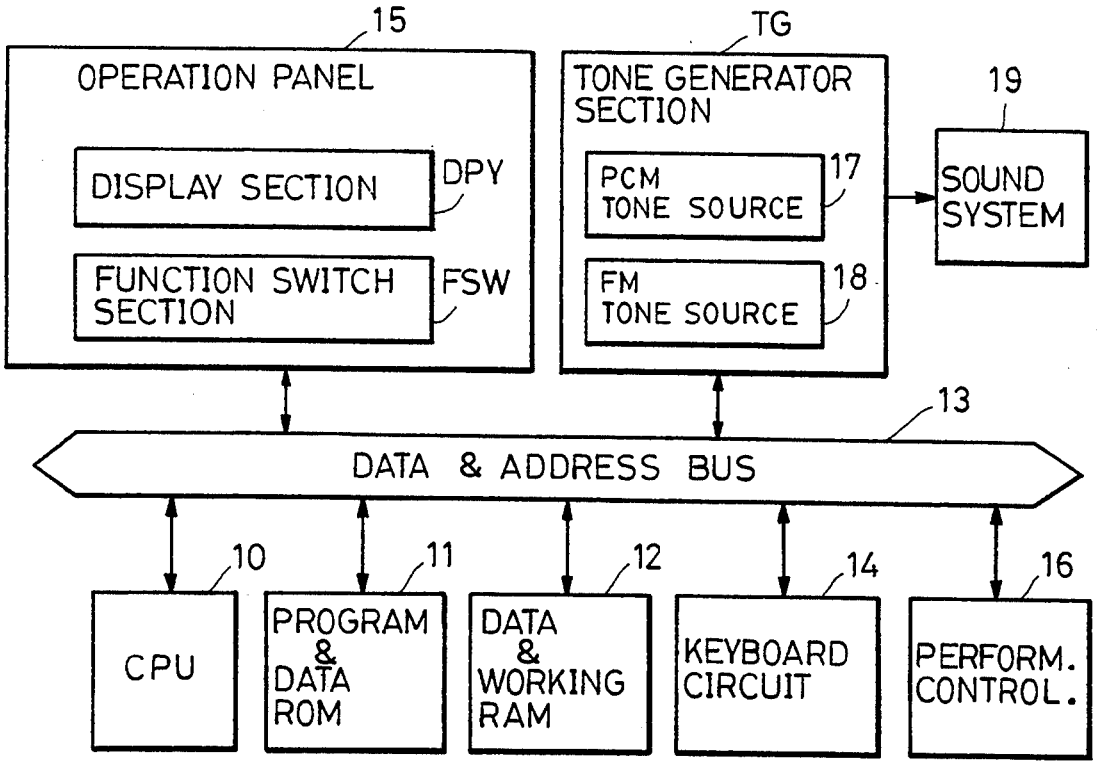
FIG. 2 is a block diagram showing schematically the entire structure of an electronic musical instrument incorporating an embodiment of the tone signal generation device according to the invention.

Some important structure of a preferred embodiment of the invention are extracted and shown in FIGS. 1A to 1E and its specific examples are shown in FIG. 2 and subsequent figures. A brief explanation will first be made about FIGS. 1A to 1E and description in detail will be made with respect to the specific examples shown in FIG. 2 and the subsequent figures.

The tone signal generation device shown in FIGS. 1A comprises a first tone source section 201 for generating a tone signal in response to tone generation designation information, a second tone source section 202 for generating a tone signal by executing a predetermined modulation operation in response to tone generation designation information, a modulating signal introduction control section 203 for controlling introduction of an output tone signal of the first tone source section 201 to a modulating signal input of the second tone source section 202, and a tone generation control section 204 for performing a control for simultaneously generating the output tone signals of the first and second tone source sections 201 and 202.

By the modulating signal introduction control section 203, a control for introducing the output tone signal of the first tone source section 201 to the modulating signal input of the second tone source section 202 can be performed. By this control, the output tone signal of the first tone source section 201 can be used as a modulating signal as required and the range of forming a tone by the modulation operation can be broadened.

Moreover, by the tone generation control section 204, a control for simultaneously generating the output tone signals of the first and second tone source sections 201 and 202 can be performed. A diversified and wide-range tone forming can thereby be realized by suitably combining the outputs of the two tone source sections 201 and 202 ranging from a tone color peculiar to the first tone source section 201 to a tone color peculiar to the second tone source section 202.

The tone signal generation device shown in FIG. 1B comprises plural tone source sections 211, 212 for forming tone signals by tone generation systems which are different from one another, a tone color parameter generation section 213 for generating at least element type information designating, with respect to each of element tone colors which are combined together to form a complex tone color, which tone source section 211 or 212 should generate a partial tone signal corresponding to each of the element tone colors, and parameter information for each of the element tone colors, and a distribution section 214 for distributing, responsive to the element type information for each element tone color, the parameter information corresponding to the element tone color to the tone source section 211 or 212 designated by the element type information, the respective tone source sections 211, 212 generating partial tone signals each having an element tone color corresponding to the distributed parameter information and a tone signal corresponding to the complex tone color being generated by combining these partial tone signals.

A single complex tone color can be composed of plural element tone colors and which tone source section should generate a partial tone signal corresponding to each of the element tone colors can be individually designated by the element type information. Therefore, a single complex tone color can be formed by actively utilizing tone source sections made of different tone source systems in various combinations whereby the range of tone forming can be broadened and forming of a more complex and diversified tone can be realized.

The tone signal generation device shown in FIG. 1C comprises an edit designation section 215 designating change of setting of contents of the parameter information with respect to one of the element tone colors of the single complex tone color, and an edit control section 216 for controlling, responsive to the element type information concerning the element tone color designated by the edit designation section 215, change or setting of contents of the parameter information adapted to the tone generation system of the respective tone source sections 212, 213.

Change or setting of contents of the parameter information with respect to one of the element tone colors of the single complex tone color can be designated and an automatic control is made so that, responsive to the element type information concerning the designated element tone color, change or setting of contents of the parameter information adapted to the tone generation system of the respective tone source sections can be made. Therefore, in editing tone color data, it is not necessary to designate each time which element tone color should be made by which tone source system, so that the editing work can be made more effectively.

The tone signal generation device shown in FIG. 1D is one in which the tone color parameter generation section 213 comprises a data memory 217 which stores tone color data containing the parameter information and the element type information for each of a plurality of the complex tone colors, and the tone signal generation device further comprises an edit designation section 218 for selecting one of the complex tone colors and designating change or setting of contents of the tone color data of the selected complex tone color, an edit memory section 219 for reading the tone color data concerning the complex tone color designated by the edit designation section 218 from the data memory 217 and storing the tone color data, and an edit execution section 220 for applying change or setting to the tone color data stored in the edit memory 219 section.

Tone color data of a desired single complex tone color about which editing should be made is stored from the data memory 217 to the edit memory section 219 and data editing such as change and setting is applied to the tone color data stored in the edit memory section 219. This enables the device to cope with increase in the data amount by providing a spare memory capacity in the edit memory section 219, so that degree of freedom in data editing is improved.

The tone signal generation device shown in FIG. 1E comprises a first tone source section 221 capable of generating tone signals in N channels, a second tone source section 222 capable of generating tone signals in M channels, the second tone source section 222 having a tone generation system different from a tone generation system of the first tone source section 221, a tone source-system number combination information generation section 223 for generating tone source-system number combination information consisting of information specifying respectively number "a" of tone signals to be generated simultaneously in correspondence to common tone generation designation information in the first tone source sections 221 and number "b" of tone signals to be generated simultaneously in correspondence to the common tone generation designation information in the second tone source section 222, and an assigning section 224 responsive to tone generation designation information and the tone source-system number combination information for assigning generation of tone signals corresponding to the tone generation designation information to the "a" channels among the N channels in the first tone source section 221 and assigning generation of tone signals corresponding to the tone generation designation information to the "b" channels among the M channels in the second tone source section 222, tone signals being generated in the respective channels of the respective tone source sections 221, 222 in accordance with these assignments.

By setting the numbers "a" and "b" to desired values and designating tone generation by depressing a certain key to designate a desired tone pitch, generation of a tone signal corresponding to the depressed key is assigned to "a" channels among N channels of the first tone source section 221 and also assigned to "b" channels among M channels of the second tone source section 222. Tone signals corresponding to the depressed key are generated in "a" channels in the first tone source section 221 and in "b" channels in the second tone source section 222. The tone signals generated in the first tone source section 221 and those generated in the second tone source section 222 may be added together and a tone signal corresponding to the single depressed key is formed. By this arrangement, two different tone sources can be actively utilized in various combinations and forming of a complex and diversified tone can be realized.

General Description of the Entire Construction

FIG. 2 hardware structure block diagram is a showing an embodiment of the tone signal generation device according to the invention. In this embodiment, various processing is executed under the control of a microcomputer including a central processing unit (CPU) 10, a program and data ROM 1I and a data and working RAM 12. Circuits including a keyboard circuit 14 and an operation panel 15 are connected to the microcomputer through a data and address bus 13.

The keyboard circuit 14 which is provided in correspondence to a keyboard having a plurality of keys for designating tone pitches of tones to be generated is a circuit including key switches corresponding to the respective keys in the keyboard. This keyboard circuit 14 may include a key scanning circuit for detecting the on-off state of each key switch or, alternatively, key scanning may be performed by the microcomputer.

The operation panel 15 includes various operators for selecting, setting and controlling tone color, tone volume, tone pitch, tonal effect etc. For performing various selections and settings, a display section DPY and a function switch section FSW are provided.

A performance controller 16 is an Operator for controlling tone color, tone volume, tone pitch etc. during performance and includes, for example, a control wheel, a control pedal or a press controller.

A tone generator section TG includes two different tone source circuits, e.g., a PCM tone source 17 and an FM tone source 18 and is capable of generating tone signals having tone pitches corresponding to keys which have been depressed in the keyboard simultaneously in the two tone sources 17 and 18. The tone sources 17 and 18 have respectively N and M tone generation channels. In this embodiment, it is assumed that N=M=16 and the tone sources 17 and 18 can respectively generate tone signals in sixteen channels on a time shared basis.

Various processing including detection of key-on and key-off in the keyboard circuit 14, detection of operation state of the operators in the operation panel 15, detection of operation state of the performance con,-roller 16 and assignment of generation of a tone corresponding to a depressed key are performed under the control of the microcomputer and necessary data are supplied to the tone generator section TG through the bus 13. The tone generator section TG generates a tone signal in response to the supplied data and the generated tone signal is audibly sounded as a tone through a sound system 19.

Description of an Example of the Tone Generator Section TG

Figure 3:
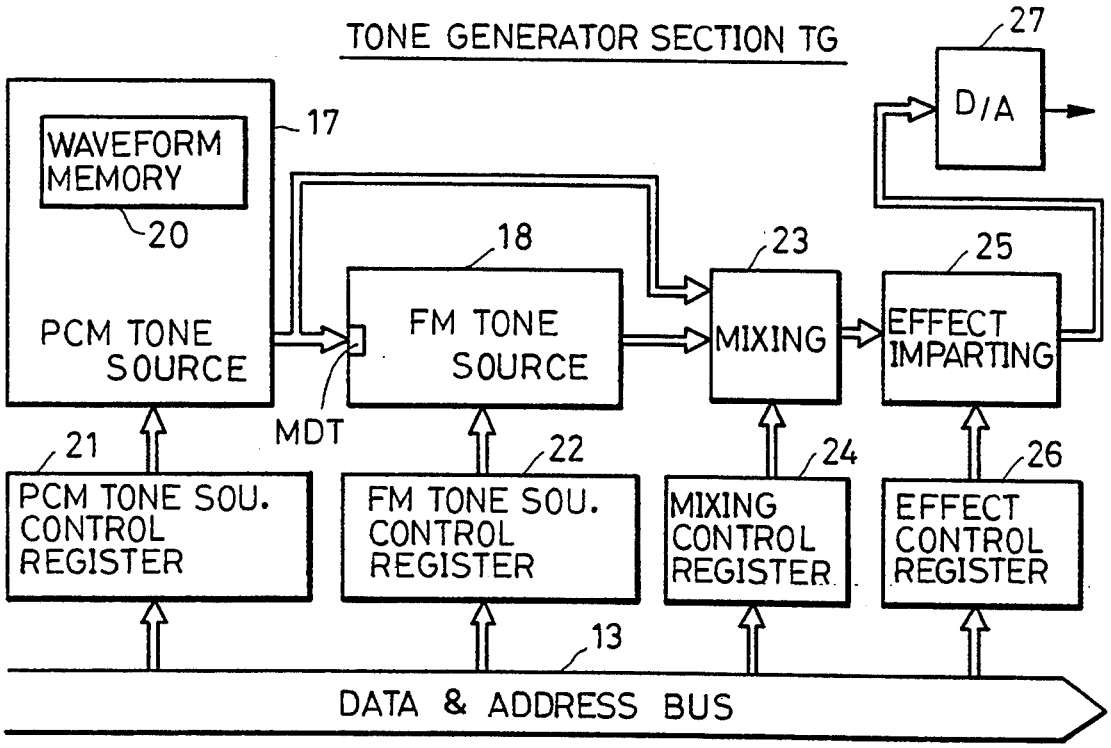
FIG. 3 is a block diagram showing an example of a tone generator shown in FIG. 2.

Referring to FIG. 3, an example of the tone generator section TG will be described. The PCM tone source 17 includes a waveform memory 20 prestoring tone waveforms corresponding to various tone colors and employs basically a tone source system called "waveform memory readout system" according to which a tone signal is generated by sequentially reading tone waveform sample value data from the waveform memory 20 in response to address data which changes in correspondence to the tone pitch of a tone to be generated. In this case, a tone waveform stored in the waveform memory 20 may be only a waveform of one cycle but it should preferably be a waveform of plural cycles from the standpoint of improving the tone quality. As the system in which a waveform of plural cycles is stored in and read from the waveform memory, there are many known systems such as: the system disclosed in Japanese Patent Application Laid-open No. 52-121313 in which a full wave from the start of generation of a tone to the end thereof is stored and read out only once; the system disclosed in Japanese Patent Application Laid-open No. 58-142396 in which an attack portion waveform of plural cycles and a sustain portion waveform of one or plural cycles are stored and the attack portion waveform is read once and thereafter the sustain portion waveform is repeatedly read out; and the system disclosed in Japanese Patent Application Laid-open No. 60-147793 in which plural waveforms which have been intermittently sampled are stored, a waveform to be read out is designated one after another sequentially and the designated waveform is repeatedly read out. Any of the systems may be employed as desired. In this embodiment, it is assumed that, by way of example, the system in which an attack portion waveform of plural cycles is read out once and thereafter a sustain portion waveform is repeatedly read out is employed.

The FM tone source 18 employs a tone source system called "FM tone source system" in which tone waveform sample value data is computed by executing a frequency modulation operation as phase angle parameter which changes at a desired frequency corresponding to the tone pitch of a tone.

The tone sources 17 and 18 can respectively generate sixteen tone signals at the maximum on a time shared basis and has a known function of imparting an amplitude envelope to a generated tone signal.

Key codes KC of keys which have been assigned to respective channels of the PCM tone source 17, key-on signals KON representing depression and release of the keys and various control data for setting and controlling tone color, tone volume, tone pitch etc. are supplied from the microcomputer to a PCM tone source control register 21 through the bus 13. The PCM tone source 17 generates tone signals of the tones assigned to the respective channels in response to these data stored in the register 21.

Similarly, key codes KC of keys which have been assigned to the respective channels of the FM tone source 18, key-on signals KON representing depression and release of the keys and various control data for setting and controlling tone color, tone volume, tone pitch etc. are supplied from the microcomputer to an FM tone source control register 22 through the bus 13. The FM tone source 18 generates tone signals of the tones assigned to the respective channels in response to these data stored in the register 22.

As is well known, in the FM tone source system, a tone signal having a desired spectrum is basically generated by generating a carrier signal and a modulating wave signal and modulating the carrier signal with the modulating wave signal. The FM tone source 18, therefore, can generate a carrier function and a modulating wave function by itself.

In this embodiment, the modulating wave function is not only generated inside of the FM tone source 18 but a modulating wave signal is also introduced from outside through a modulator input terminal MDT so that a tone signal which has been generated in the PCM tone source 17 is applied to the modulator input terminal MDT of the FM tone source 18. The output tone signal of the PCM tone source 17 which has been applied to the modulator input terminal MDT is control led in its level in the FM tone source 18 and also control led as to whether the PCM tone source output tone signal can be used as the modulating wave signal or not.

A mixing circuit 23 is provided for mixing a tone signal generated by the PCM tone source 17 with a tone signal generated by the FM tone source 18. A control for the mixing is performed in accordance with control data supplied from a mixing control register 24. This mixing control data is supplied from the microcomputer through the bus 13 in accordance with, e.g., a selected tone color. The mixing operation is not limited to addition but it may be subtraction. Time division timings of sixteen channels in the PCM tone source 17 and the FM tone source 18 are synchronized with each other, so that when tone signals corresponding to the same depressed key are to be generated simultaneously in the PCM tone source 17 and the FM tone source 18, tone signals corresponding to this depressed key are assigned to the channels of the same timing in the PCM tone source 17 and the FM tone source 18.

The output of the mixing circuit 23 is supplied to an effect imparting circuit 25 in which various effects such as a reverberation effect and a PAN effect are imparted to a tone signal when desired. Control data for controlling the imparting of these effects are supplied from the microcomputer to an effect control register 26 through the bus 13 and then supplied to the effect imparting circuit 25.

The tone signal provided from the effect imparting circuit 25 is applied to a digital-to-analog converter 27 for being converted to an analog signal and thereafter supplied to the sound system 19. For cancelling the channel time division mode, an accumulator (not shown) for accumulating tone signals of the respective channels may be provided. This accumulator may preferably be provided in a former stage of the digital-to-analog converter 27, e.g., in the mixing circuit 23.

Description of an Example of the Internal Construction of the FM Tone Source

Figure 4:
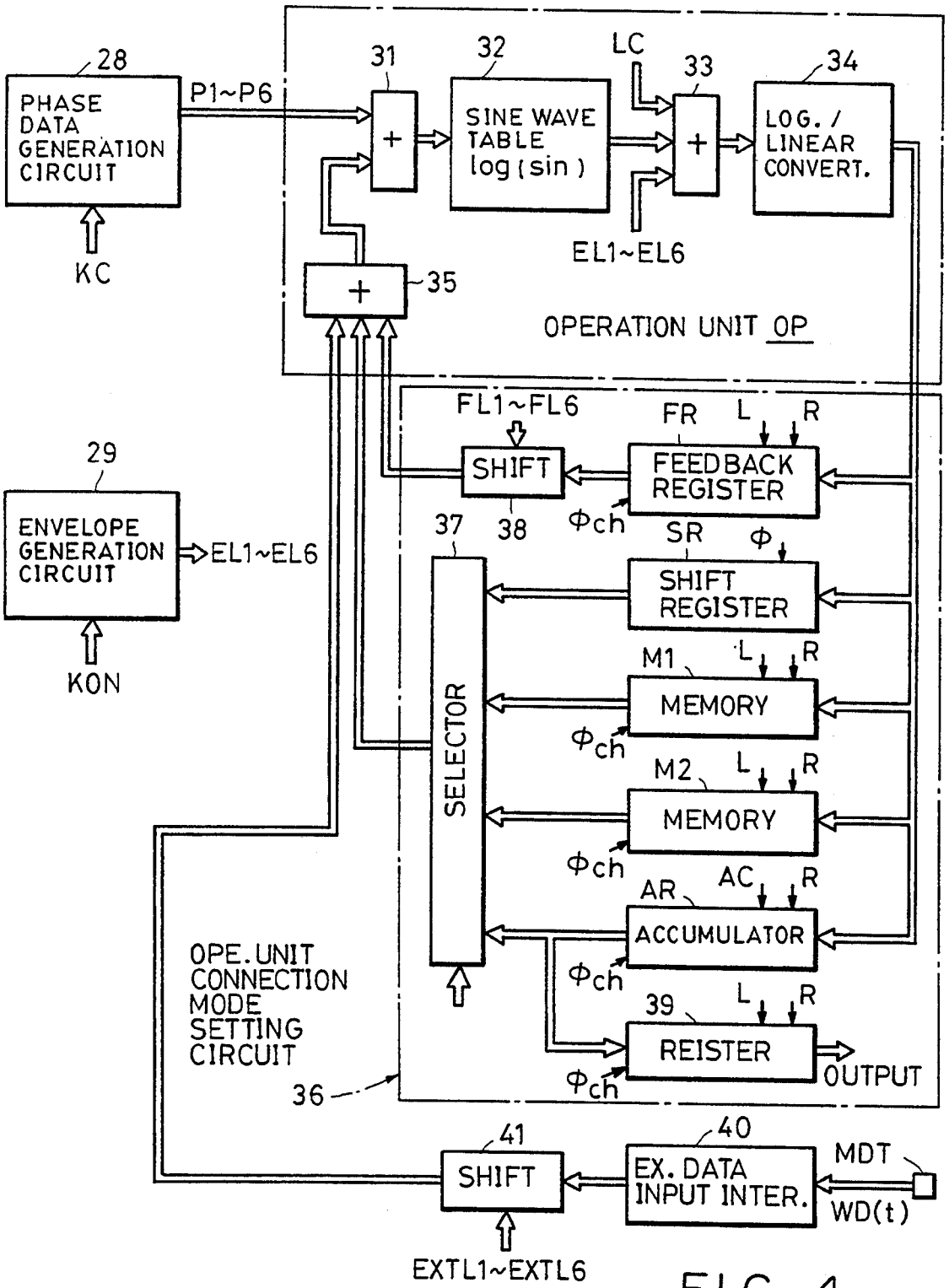
FIG. 4 is a block diagram showing an example of an FM tone source in FIG. 3.

Referring to FIG. 4, an example of the internal construction of the FM tone source 18 will be described. In the FM tone source 18 of this example, an FM operation is performed to synthesize a tone by using six operation units OP1 to OP6 for a single tone. By selectively switching the mode of connection among the operation units OP1 to OP6, algorithm of the FM operation is selected to synthesize a tone of a desired tone color. The FM tone source 18 of this example has a single operation unit OP in terms of the hardware structure and this operation unit or functions as six operation units OP1 to OP6 by using it at six time slots on a time shared basis.

A phase data generation circuit 28 receives key codes KC and key-on signals KON of the keys which have been assigned to the respective channels and generates phase data P1 to P6 corresponding to the key codes KC in correspondence to the operation units OP1 to OP6 at six time slots for one channel on a time shared basis and in sixteen channels on a time shared basis. An envelope generation circuit 29 generates, in response to the key-on signals KON, envelope level data EL1 to EL6 corresponding to the operation units OP1 to OP6 at six time slots for one channel on a time shared basis and in sixteen channels on a time shared basis.

Various parameter data or control data corresponding to, e.g., a selected tone color are supplied to the control register 22 (FIG. 3) through the bus 13 and therefrom to the circuits in the FM tone source 18 (the phase data generation circuit 28, envelope generation circuit 29, operation unit OP and other circuits) in correspondence to the timings of the operation units OP1 to OP6 on a time shared basis (and in each channel on a time shared basis if necessary). By these parameters are controlled coefficients of the phase data F1 to F6, the mode of generation of the envelope level data EL1 to EL6 (i.e., envelope shapes) and the mode of FM operation. If, for example, it is possible to select a mode of connection according to which the operation units OP1 to OP6 are divided in plural lines and arranged in parallel for each of the lines and outputs of these lines are added together, level correction data LC for correcting the tone volume level in accordance with the number of the addition lines is included in the FM operation control parameters. Feedback level data FL1 to FL6 for setting a feedback level in self-feeding back an output signal of its own operation unit as the modulating wave signal are also included in the FM operation control parameters. Control signals for setting the mode of connection of the operation units OP1 to OP6 are also included in the FM operation control parameters. External input level control data EXT1 to EXT6 for controlling the level of tone signals from the PCM tone source 17 when the tone signals are used as the modulating wave signals in the operation units OP1 to OP6 are also included in the FM operation control parameters.

The operation unit OP includes an adder 31 for modulating input phase data P1 to P6, a sine wave table 32 storing sample values of a sine wave expressed in the form of a logarithm table, an adder 33 for amplitude control, a logarithm-linear conversion circuit 34 and an adder 35 for adding a modulating signal. The adder 31 adds the phase data F1 to F6 provided on a time shared basis at the timing of the time slots of the operation units OF1 to OP6 and a wave signal (i.e. modulating signal) supplied from the adder 35 together for performing phase modulation. The adder 33 adds the envelope level data EL1 to EL6 and the level correction data LC to sine wave sample data in logarithmic expression read from the the sine wave table 32 in response to the output of the adder 31. The data EL1 to EL6 and LC are also provided in logarithmic expression and mulitplication of amplitude coefficient is substantially made by the addition of the data in logarithmic expression. The logarithm-linear conversion circuit 34 converts the output of the adder 33 to data in linear expression.

An operation unit connection mode setting circuit 36 includes a feedback register FR, one-stage shift register SR, memories M1 and M2 and an accumulator AR which respectively receive the output of the operation unit OP, and it also includes a selector 37 which receives the outputs of the register SR, memories M1 and M2 and accumulator AR, a multiplier or shift circuit 38 for multiplying the output of the feedback register FR with the feedback level data FL (FL1 to FL6), and a register 39 which latches the output of the accumulator AR. The output of the register 39 is provided as a tone signal which has been synthesized by the FM tone source 18.

The registers FR and 39, memories M1 and M2 and accumulator AR have memory capacity of sixteen channels and are control led by a sixteen channel time division processing in response to a channel clock pulse $\phi$ ch. The shift register SR however is shift-controlled at each time slot in response to a clock pulse $\phi$.

The feedback register FR, memories M1 and M2 and register 99 have a load input L and a reset input R to which the control signals are applied to control loading and resetting of data therein. The accumulator AR has an accumulation enable input AC and a reset input R to which the control signals are applied to accumulation and resetting of data therein. These control signals are applied also to a selection control input of the selector 37 to control which input data should be selected. The outputs of the selector 37 and shift circuit 38 are applied to a modulating signal inputting adder 35 and added therein.

The feedback register FR stores waveform signal data which is a result of operation in a predetermined operation unit and which is to be fed back to the same operation un it or a former stage operation unit. A signal "1" is supplied to the load input L at the time slot at which the result of operation in the predetermined operation unit is provided from the operation unit OP. The feedback level data FL1 to FL6 exhibit some value at a time slot of the operation unit in which a feedback route is to be formed and a signal obtained by shifting the output signal of the register FR in accordance with this value is supplied to the adder 35. At time slots at which no feedback route is provided, the feedback level data FL1 to FL6 have contents corresponding to level 0, so that the shift circuit 38 is thereby interrupted and its output becomes 0.

The shift register SR shifts its contents in response to the clock pulse $\phi$ and result of operation at a certain time slot is delivered out at a next time slot. The memories M1 and M2 hold result of operation at a desired time slot. The accumulator AR adds output signals of any one or more operation units among the operation units OP1 to OP6. A signal "1" is supplied to the accumulation enable input AC at a time slot corresponding to a unit in which addition is to be made. The selector 37 realizes mutual connection of the operation units OP1 to OP6 following a predetermined mode of connection by selecting a proper output signal from among output signals of the register SR, memories M1 and M2 and accumulator AR as a waveform signal (modulating signal) to be supplied to an input Win1 of the operation unit OP at respective time slots corresponding to the operation units OP1 to OP6. In the output register 39, a signal "1" is applied to the load input L at the end of one operation cycle at which the time slots of all operation units OP1 to OP6 complete one cycle and the output register 39 thereupon latches the output of the accumulator AR. Thus, one sample value data of a tone signal obtained as a result of operation by connecting the operation units OP1 to OP6 in the predetermined mode of connection is latched in the register 39.

The output signal of the PCM tone source 17 applied on a time shared basis for each channel through the modulator input terminal MDT is loaded in an external data input interface 40 and provided out at time division timing for each channel and applied to a shift circuit 41. The external input level control data EXTL1 to EXTL6 supplied to the shift circuit 41 exhibit a proper value at the time slots of the operation units OP1 to OP6 thereby controlling the PCM tone source output signal used as the modulating wave signal. At a time slot of an operation unit at which the PCM tone source signal is not used as the modulating wave signal, the external input level control data EXTL1 to EXTL6 are of contents corresponding to level 0, so that the shift circuit 41 is interrupted and its output becomes 0. The output of the shift circuit 41 is applied to the adder 35 and the output of the adder 35 is supplied to the adder 31 as a modulating wave signal.

Figure 5:
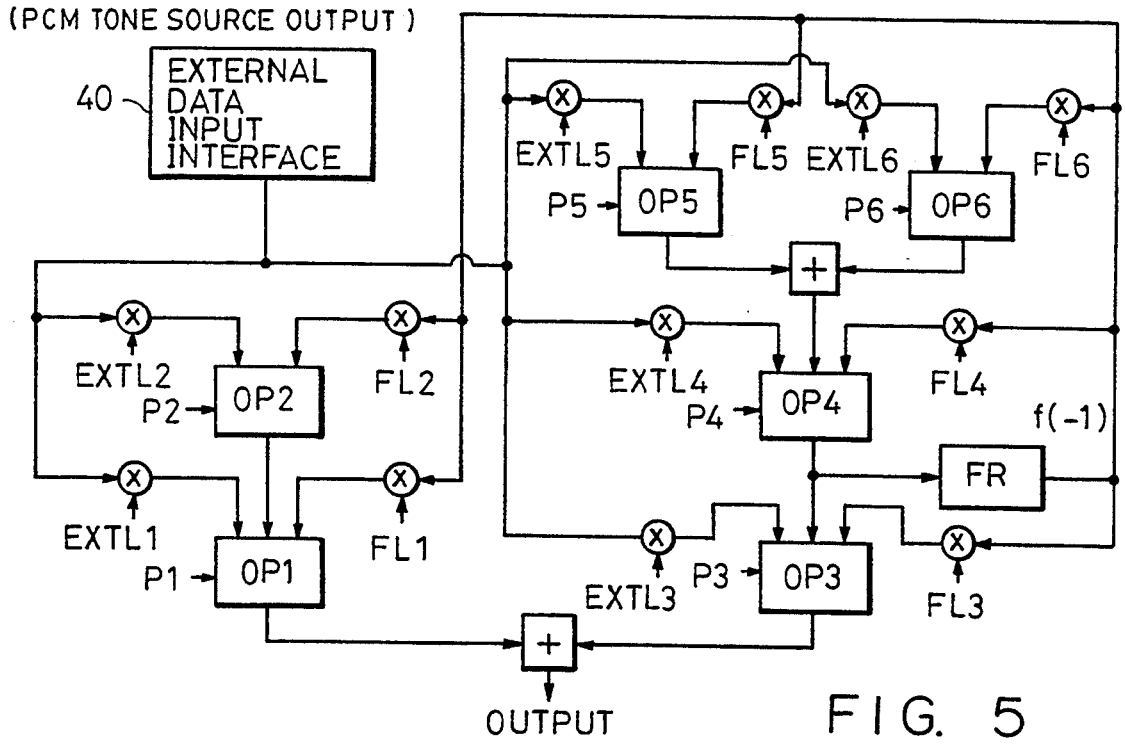
FIG. 5 is a functional block diagram showing an example of combination of connection of FM operation units in FIG. 4.

By way of example, a case in which six operation units OP1 to OP6 are connected as shown in FIG. 5 will be explained. In this mode of connection, the operation unit OP4 is selected as a predetermined operation unit which feeds back its output signal to itself or to other operation unit to be fed back. The output signal of this operation unit OP4 is stored in the feedback register FR and the output signal of the register FR is fed back to the input sides of the same unit OP4 and former stage operation units OP5 and OP6 and, besides, is applied to operation units OP1 and OP2 provided in parallel to the unit OP4 in a separate channel and, further, is applied to a posterior stage operation unit OP3. Data FL1 to FL6 which are applied as multiplier to multiplication circuits (corresponding to the shift circuit 38) provided in paths leading the output of the register FR to the modulating signal input of the operation units OP1 to 0P6 are feedback level data corresponding to the operation units OP1 to OP6. The output signal of the register FR applied to the operation units OP1 to OP3 is not a feedback signal to these operation units OP1 to OP3. However, it is also possible to provide a mode of connection in which such signal fed back to the same operation unit or former stage operation unit is applied also to an operation unit of a separate channel or a posterior stage operation unit.

The data EXTL1 to EXTL6 applied as multiplier to multiplication circuits (corresponding to the shift circuit 41) provided in paths leading the output of the external data input interface 40 to the modulating signal inputs of the operation units OP1 to OP6 are external input level control data corresponding to the operation units OP1 to OP6.

Figure 6:
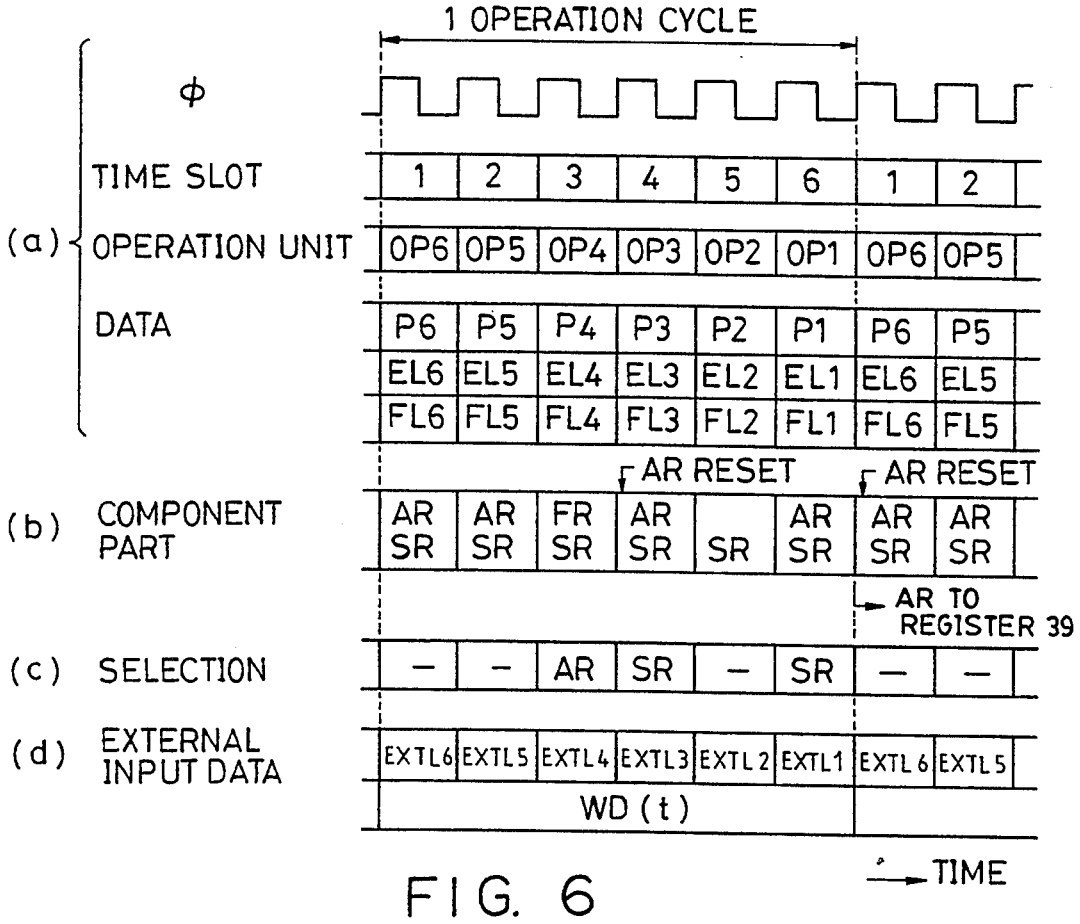
FIG. 6 is a time chart of signals for realizing the combination of connection of FIG. 5 in FIG. 4.

The time division time slots corresponding to the operation units OP1 to OP6 are as shown in part (a) of FIG. 6. Six time slots 1 to 6 corresponding to one sampling time for one channel correspond respectively to the operation units OP1 to OP6 in the order of time elapsed. At respective time slots 1 to 6, therefore, phase data P6 to P1, envelope level data EL6 to EL1 and feedback level data FL6 to FL1 corresponding to the operation units OP6 to OP1 are supplied as shown in part (a) of FIG. 6.

In a case where the connection of FIG. 5 is realized, components parts to which the output signal of the operation unit OP is loaded at respective time slots 1 to 6 are as shown in part (b) of FIG. 6 and selection in the selector 37 is made as shown in part (c) of FIG. 6.

The timing of supply of the external input level control data EXTL1 to EXTL6 corresponding to the operation units OP1 to OP6 and timing of one sample data WD(t) for one channel provided from the external data input interface 40 are as shown in part (d) of FIG. 6.

Since, as described above, the time division timings of sixteen channels in the PCM tone source 17 and the FM tone source 18 are synchronized with each other and, when tone signals corresponding to the same depressed key are to be generated simultaneously in the PCM tone source 17 and the FM tone source 18, tone signals corresponding to the depressed key are assigned to channels of the same timing in the PCM tone source 17 and the FM tone source 18, the output tone signal of the PCM tone source 17 corresponding to the same depressed key can be readily utilized as the modulating wave signal in the FM tone source 18.

DESCRIPTION OF AN EXAMPLE OF THE OPERATORS

Referring now to FIG. 7, an example of operators in the operation panel 15 and the display section DPY will be described. The display section DPY consists, for example, of a liquid crystal display and can selectively display one of plural pictures for selecting, setting or changing tone color, tone volume, effect etc. In the following description, one picture is called "page". A function switch section FSW has function switches F1 to F8 arranged below the display section DPY. The functions of the function switches F1 to F8 are changed in accordance with the state of picture, i.e., contents of page, of the display section DPY. In the picture on the display section DPY, functions currently assigned to the function switches F1 to F8 are displayed in positions corresponding to the function switches F1 to F8. A shift key SHIFT adjacent to the function switches F1 to F8 is provided for shifting the function display of the respective function switches F1 to F8 in the picture on the display section DPY. This shift key SHIFT is used when double functions are being assigned to the function switches F1 to F8 in one picture (one page).

A data input section 42 is a slide type operator for inputting numerical data.

A voice key VOICE is a key switch for calling a voice selection page in the display section DPY. The voice selection page is a picture displayed when a desired voice, i.e., tone color (more exactly, complex tone color) is to be selected.

An edit key EDIT is a key switch operated when an editing work for changing or correcting contents of a desired voice is to be started.

A store key STORE is a key switch operated for storing edited voice data when the editing work has been completed.

An enter key ENTER is a key switch operated for establishing inputting of data.

Cursor keys CSR are key switches operated when the cursor display in the display section DPY is to be moved vertically or horizontally or increase or decrease of numerical data is to be designated.

There are other switches and operators in the operation panel 15 but description thereof will be omitted.

Description About Voice

Tone colors available for use in an electronic musical instrument include various tone colors such as instrument tone colors which simulate tone colors of existing musical instruments such as piano and violin and tone colors which can be determined or altered as desired by a player. In this embodiment, the latter tone colors are called "voice". The term voice however does not exclude the tone colors such as the instrument tone colors at all. That is, the voice may be one which simulate an instrument tone color such as a piano tone color. In this embodiment, description will be made on the assumption that tone color means "voice". However, as the electronic musical instrument as a whole, an instrument tone color or any preset tone color other than voice may be selected. In this embodiment, a tone signal corresponding to one voice is generated by synthesizing tone signals generated in plural systems. In this case, a tone signal or its tone color which is a component element of one voice is called "element" or "element tone color". In this sense, voice in this embodiment may be defined as "complex tone color" produced by combining plural-element tone colors.

Figure 8:
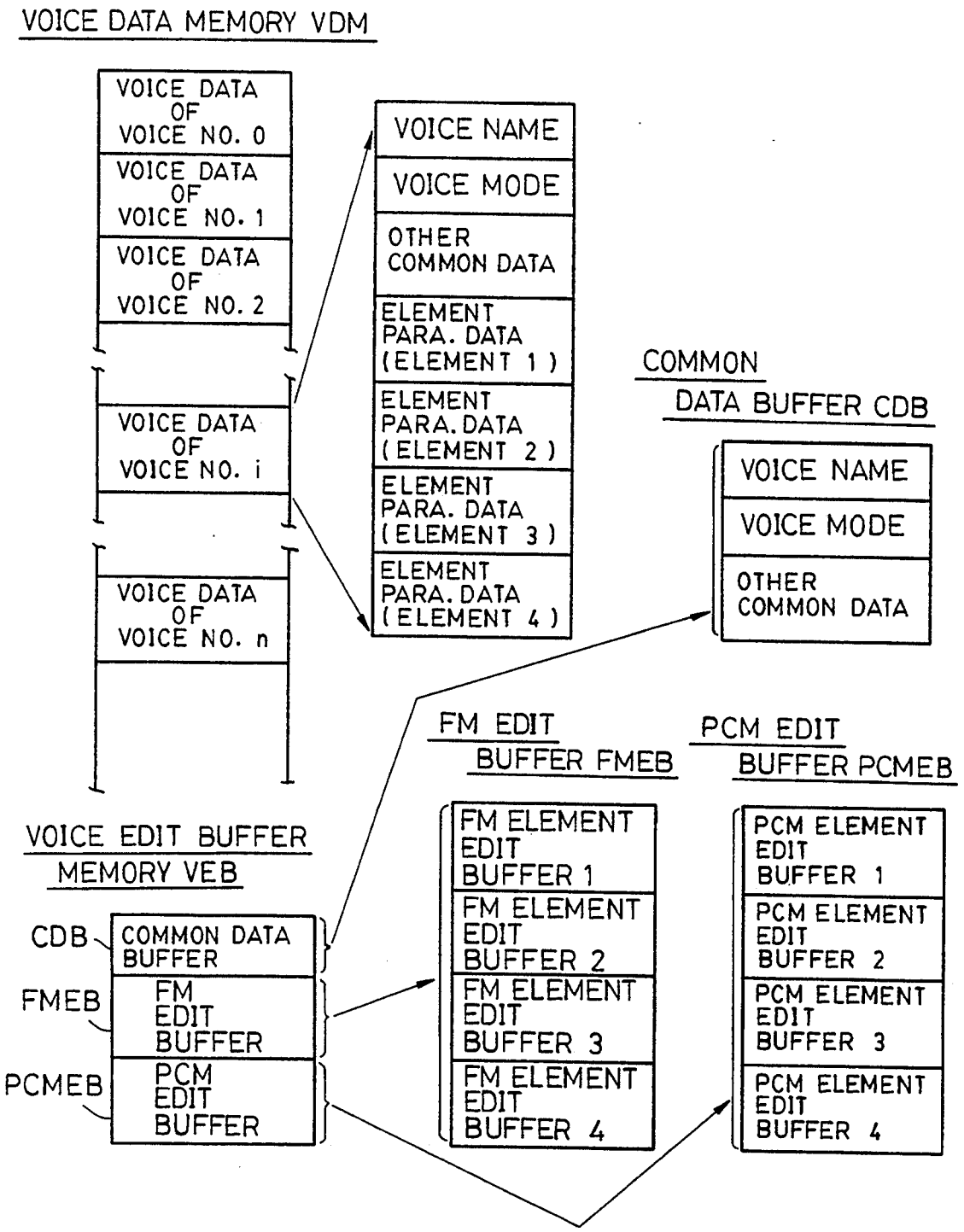
FIG. 8 is a diagram showing an example of a memory map of a voice data memory and a voice edit buffer memory.

Referring now to FIG. 8, an example of memory formats of a voice data memory VDM and a voice edit buffer memory VEB will be described.

The voice data memory VDM stores, for each voice, voice data realizing the voice. The voice edit buffer memory VEB is a buffer storing voice data of a voice under editing. These voice data memory VDM and the voice edit buffer memory VEB consist of random-access memories and a part of the data and working RAM 12 (FIG. 2 may be utilized as these memories.

The voice data memory VDM has, for each voice distinguished from one another by the voice number 0 to n, voice data area for storing voice data of respective voices. The head address of each voice data is designated by a voice point VOICEP.

One voice data area consists of an area storing a "voice name", an area Storing a "voice mode", an area storing "common data" and four "element parameter data" areas storing parameter data corresponding to four individual elements.

In this embodiment, one voice can be synthesized by using four elements at the maximum. One element corresponds to a tone signal of one system generated by using one channel in the PCM tone source 17 or the FM tone source 18. The type of parameter data for realizing a desired tone color (element tone color) differs between the PCM tone source 17 and the FM tone source 18 and contents of data vary with the element tone color. On the other hand, there is parameter data which is common to all element tone colors. This parameter data common to all elements in a particular voice is called "common data" and this "common data" is stored in the "common data" area. On the other hand, parameter data which varies with the element is called "element parameter data" and stored in the "element parameter data" area corresponding to each element. The head address of each "element parameter data" area is designated by element start pointers ESP(1) to ESP(4). The elements which are designated by the element start pointers ESP(1) to ESP(4) are distinguished from one another as elements 1 to 4.

The "voice mode" mainly designates a combination of the type of a tone source and system number used for realizing a particular voice. "Voice mode data" designating a particular mode among predetermined voice modes is stored in this "voice mode" area. As will be described later, which of the PCM tone source and the FM tone source is used or not used for each of the four elements is found depending upon what the "voice mode" is.

The voice edit buffer memory VEB has a capacity sufficient for storing a set of voice data for one voice and, more specifically, has a common data buffer CDB, an FM edit buffer FMEB and a PCM edit buffer PCMEB. The common data buffer CDB has an area for storing a "voice name", an area for storing a "voice mode" and an area for storing "common data" The FM edit buffer FMEB has FM element edit buffers 1 to 4 respectively capable of storing parameter data of the four elements. The PCM edit buffer PCMEB also has PCM element edit buffers 1 to 4 respectively capable of storing parameter data of the four elements.

The reason for providing the edit buffers FMEB and PCMEB corresponding to the different tone sources of the maximum number of the element is that this arrangement can immediately cope with a situation in which the voice mode has been changed during editing. In a case, for example, where editing of voice is made with respect to a voice mode in which the FM tone source is used with two elements and the PCM tone source is used with the other two elements, voice data of this voice is first copied from the voice data memory VDM to the voice edit buffer memory VEB. In this case, "voice name", "voice mode" and "common data" are copied to the common data buffer CDB, the parameter data of the two elements corresponding to the FM tone source are copied to two FM element edit buffers 1 and 2 in the FM edit buffer FMEB and the parameter data of the two elements corresponding to the PCM tone source are copied to the two PCM element edit buffers 1 and 2 in the PCM edit buffer PCMEB. In the remaining two FM element edit buffers 3 and 4 to which no data has been copied, a predetermined initial value (or a reference value) of "element parameter data" for the FM tone source is respectively stored. Similarly, in the remaining two PCM element edit buffers 3 and 4 to which no data has been copied, a predetermined initial value (or a reference value) of "element parameter data" for the PCM tone source is respectively stored. By this arrangement, when voice mode data stored in the common data buffer CDB during the editing work has been changed and, for example, all of the four elements have thereby been changed to a voice mode using the FM tone source (or PCM tone source), contents of the four FM element edit buffers 1 to 4 (or the four PCM element edit buffers 1 to 4) can be instantly used effectively. In other words, if the total number of the element edit buffers was limited to four which is the maximum number of the elements, the contents of the element edit buffer would have to be changed from those for the PCM tone source to those for the FM tone source (or vice versa) and this would require a comlex circuit construction. By adopting the arrangement of this embodiment, such complex circuit construction can be obviated.

The head address of each of the element edit buffers of four at the maximum among the element edit buffers totalling eight is designated by the edit start pointers EDS(1) to EDS(4).

Description of the Voice Mode

Description will now be made about "voice mode" In this embodiment, there are ten voice modes. The voice modes mainly defines a combination of the type of tone source used and the system number and further defines whether a single tone or plural tones are used and, in case of plural tones, the number of maximum tones to be generated simultaneously. The combination of the type of tone source used and the system number can be defined by defining whether the tone source used for the four elements 1 to 4 is PCM or FM, or this element is not used. This can be defined by data called "element type". There are three types of 0, 1 and 2 in "element type" contents of which are as follows:

Element 0 type . . . not used

Element type 1 . . . FM tone source is used

Element type 2 . . . PCM tone source is used The element types of the elements 1 to 4 in each voice mode are prestored in an element type table ETT having contents as shown in FIG. 9. In this element type table ETT is also stored data representing the substantial number of tones to be sounded simultaneously. Alternatively stated, the substantial number of tones to be sounded simultaneously is a maximum value at which tone signals of different depressed keys can be sounded simultaneously.

The voice modes 1 to 3 represent voices for a single tone sounding mode in which the number of tones which can be sounded simultaneously is one.

In the voice mode 1, the element 1 is of the element type 1, i.e., the FM tone source and the other elements 2 to 4 are of the element type 0, i.e., "not used". Hence, this is a voice of a single tone and one system consisting of an FM tone source element tone color.

In the voice mode 2, the elements 1 and 2 are of the element type 1, i.e., the FM tone source and the other elements 3 and 4 are of the element type 0, i.e., "not used". Hence, the this is a voice of a single tone and two systems ("two systems" means that tones of the same depressed key are generated in two channels) consisting of an FM tone source element tone color.

In the voice mode 3, all of the elements 1 to 4 are of the element type 1, i.e., the FM tone source. Hence, this is a voice of a single tone and four systems ("four systems" means that tones of the same depressed key are generated in four channels) of an FM tone source element tone color.

The voice modes 4 to 10 are voices of a plural tone sounding mode in which the number of tones to be sounded simultaneously is as described in the table.

In the voice mode 4, the element 1 is of the element type 1, i.e., the FM tone source and the other elements 2 to 4 are of the element type 0, i.e., "not used". Hence, this is a voice of plural tones and one system consisting of an FM tone source element tone color and the number of tones to be sounded simultaneously is 16.

In the voice mode 5, the elements and 1 and 2 are of the element type 1, i.e., the FM tone source and the other elements 3 and 4 are of the element type 0, i.e., "not used". Hence, this is a voice of plural tones and two systems consisting of an FM tone source element tone color and the number of tones to be sounded simultaneously is 8.

In the voice mode 6, the element 1 is of the element type 2, i.e., the PCM tone source and the other elements 2 to 4 are of the element type 0, i.e., "not used". Hence, this voice is a voice of plural tones and one system consisting of a PCM tone source element tone color and the maximum number of tones to be sounded simultaneously is 16.

In the voice mode 7, the elements 1 and 2 are of the element type 2, i.e., the PCM tone source and the other elements 3 and 4 are of the element type 0, i.e., "not used". Hence, this is a voice of plural tones and two systems consisting of a PCM tone source element tone color and the maximum number of tones to be sounded simultaneously is 8.

In the voice mode 8, all of the elements 1 to 4 are of the element type 2, i.e., the PCM tone source. Hence, this is a voice of plural tones and four systems consisting of a PCM tone source element tone color and the maximum number of tones to be sounded simultaneously is 4.

In the voice mode g, the element 1 is of the element type 1, i.e., the FM tone source, the element 2 is of the element type 2, i.e., the PCM tone source and the other elements 3 and 4 are of the element type 0, i.e., "not used". Hence, this is a voice of plural tones and two systems consisting of a combination of a PCM tone source element tone color and an FM tone source element tone color and the maximum number of tones to be sounded simultaneously is 16.

In the voice mode 10, the elements 1 and 2 are of the element type 1, i.e., the FM tone source and the elements 3 and 4 are of the element type 2, i.e., the PCM tone source. Hence, this is a voice of plural tones and four systems consisting of a combination of two PCM tone sources and two FM tone sources and the maximum number of tones to be sounded simultaneously is 8.

Description of Processing by the Microcomputer

FIG. 10 shows an example of main data stored in the registers of the data and working RAM 12. The functions of these data will become apparent from the following description made with reference to the flow charts.

FIG. 11 shows an example of contents of an entry point table EFT. The entry point table EPT is a table which designates a next routine to be executed upon occurrence of an ON event of an ON switch in the operation panel 15 in accordance with correspondence between the displayed picture (page) in the display section DPY and the ON switch.

An example of a processing executed by the microcomputer will be described with reference to the flow charts of FIG. 12 and subsequent figures.

Figure 12:
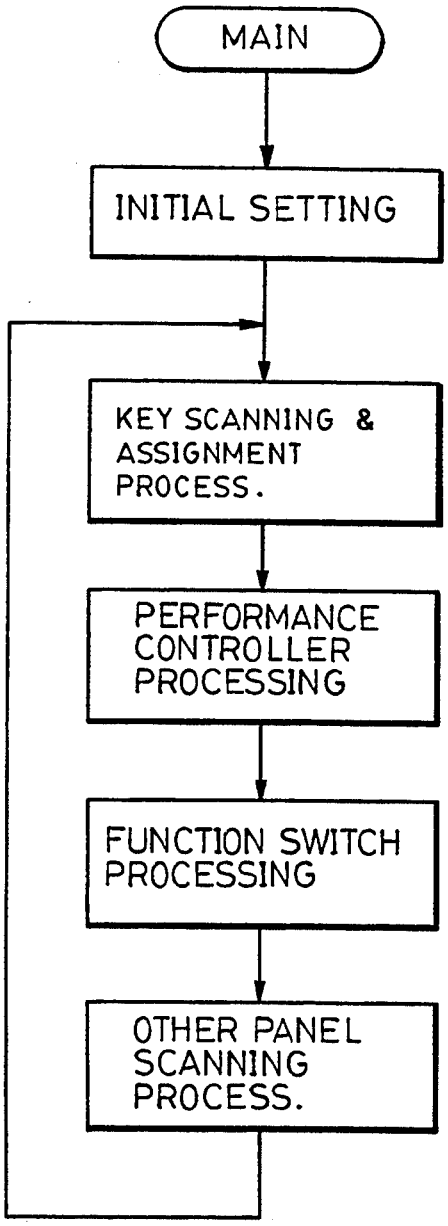
FIG. 12 is a flow chart schematically showing a main routine executed by a computer in FIG. 2.
Figure 25:
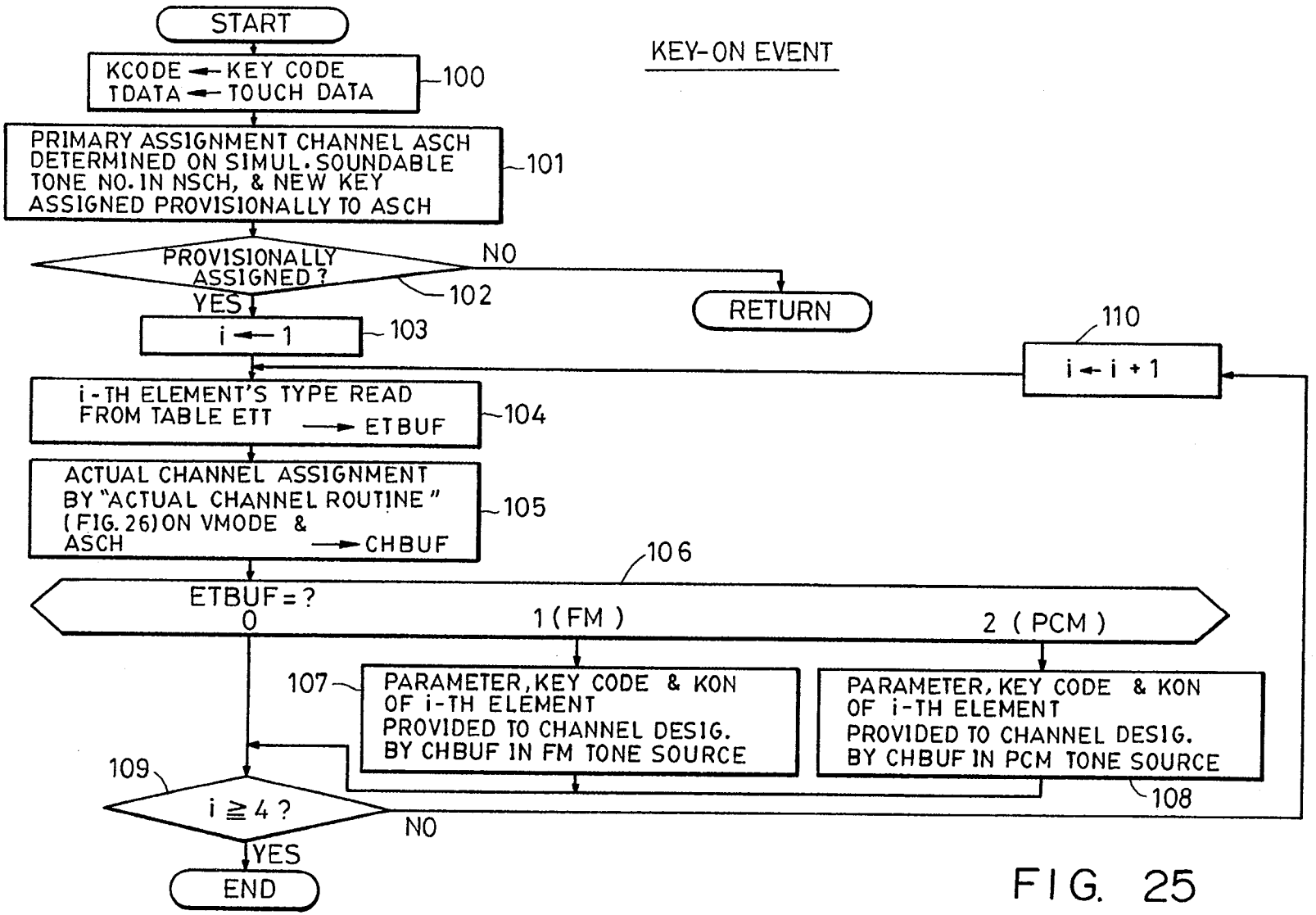
Figures 26, 27:
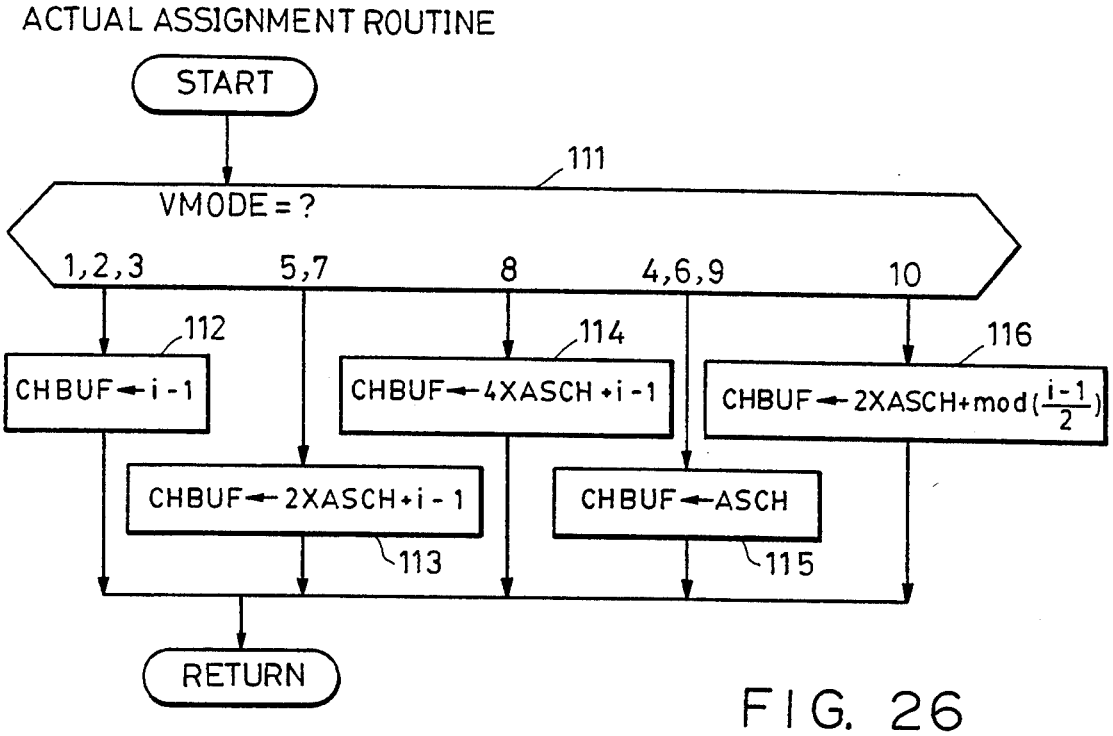

FIG. 12 shows an example of the main routine. In the main routine, a predetermined initializing processing is executed upon switching on of the power supply and then contents of the respective registers and memories are initially set. Then, in "key scanning and assignment processing", the key switches in the keyboard circuit 14 are scanned to detect their on-off state and depressed keys are assigned to any of the plural tone generation channels. As one of processing executed in the "key scanning and assignment processing, there is "key-on event processing". An example of this processing is shown in FIGS. 25 and 26 and details of this processing will be described later. In this "key-on event processing", when a key has been depressed newly, generation of a tone signal corresponding to this key is assigned to a channel of the PCM tone source 17 and/or the FM tone source 18.

In "performance controller processing", operation of the performance controller 16 is detected and a predetermined processing is made when the operation state has been changed.

Figure 13:
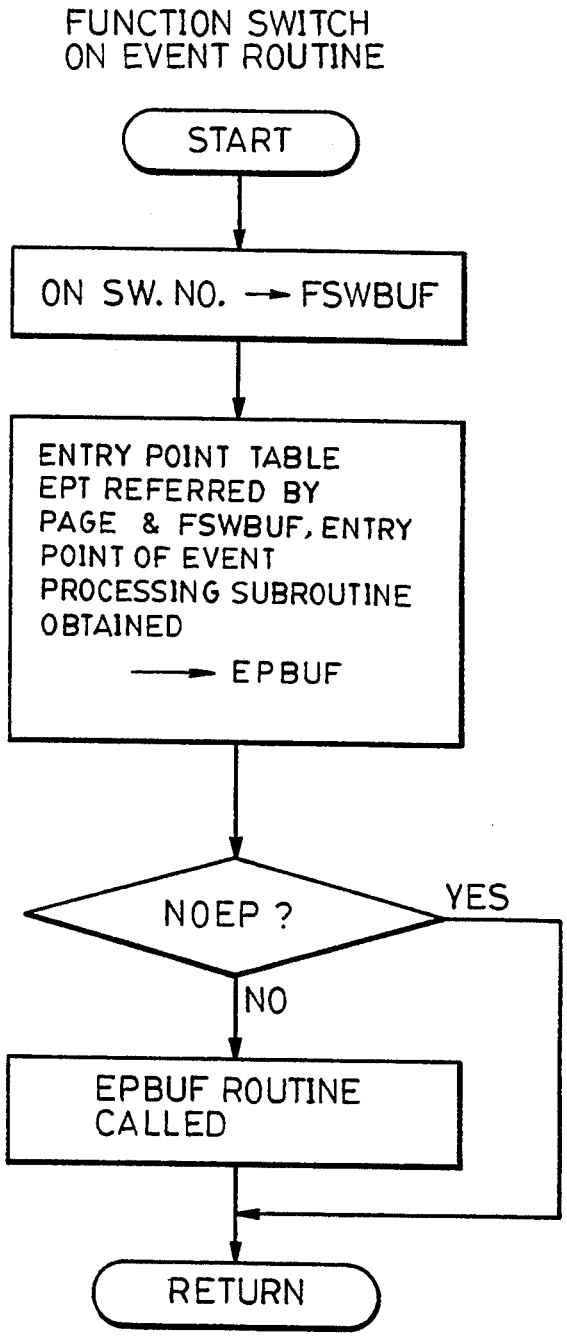

In "function switch processing", an ON event (i.e., change from an ON state to an OFF state) in the function switch section FSW is detected and, upon detection of the ON event, a function switch ON event routine as shown in FIG. 13 is executed.

In "other panel scanning processing", other operators and key switches in the operation panel 15 are scanned detect their on-off state and various processing is executed in accordance with result of the the detection. For example, the entry point table EPT in FIG. 11 is referred to in accordance with current correspondence between a key-switch which has been turned on and current page of the display section DPY, and a switch ON event subroutine shown in FIGS. 14 to 24 is called.

Explanation About the Entry Point Table EPT

In the entry point table EPT of FIG. 11, each columb represents ON events of respective keys or switches and each line represents the page in the display section DPY at a particular switch on event time point. A symbol at a crossing point of each columb and line represents a subroutine to be called (i.e., the entry point of the subroutine). Description of each subroutine will be made later. The symbol "NoEP" represents "no entry point", i.e., there is no subroutine (i.e., entry point) to be called.

Processing During Operation of a Function Switch

When any one of the function switches F1 to F8 has been turned on, a function switch ON event routine of FIG. 13 is executed. In this subroutine, the number of the function switch which has been turned on is stored in a function switch buffer FSWBUF, and then the entry point table EPT is referred to by this function switch buffer FSWBUF and current page PAGE to obtain entry point data of a predetermined event processing subroutine which is being assigned to the function switch at the page, and the obtained entry point data is stored in an entry point buffer EPBUF. After confirming that contents of this entry point buffer EPBUF are no entry point NoEP, an event processing subroutine corresponding to the contents of this entry point buffer EPBUF is called. The current page PAGE represents current displayed page in the display section DPY.

Selection of a Voice

In this electronic musical instrument, the voice number which represents a voice which is currently selected for sounding of a tone or editing is stored in a predetermined register, i.e., a voice number register. The voice number stored in this voice number register is designated by VN. By referring to this vioce number VN, which voice is currently selected can be known.

Selection of a desired voice is executed by calling a "voice selection" page as shown by way of example in FIG. 27. When a displayed picture in the display section DPY is other than "voice selection", "voice selection subroutine" EPV is called in the entry point table EPT (FIG. 11) by depressing a voice key VOICE (FIG. 7) and selection of a voice thereby can be made.

Figure 14:
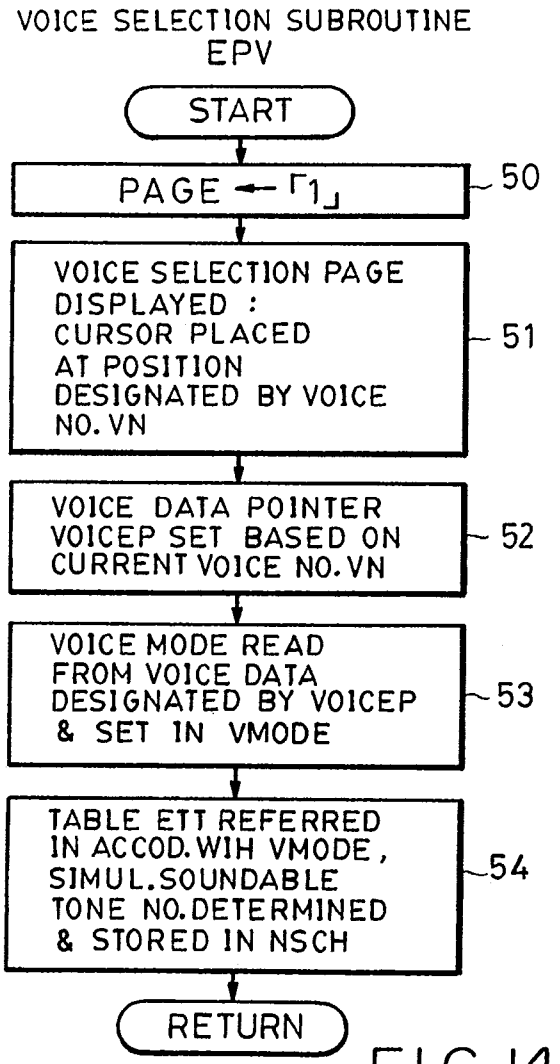

Referring to FIG. 14, the voice selection subroutine EPV will be described. First, contents of the current page PAGE designating a page in the display section DPY are set to "1" which designates "voice selection" page (step 50). Then, display in the display DPY is changed to "voice selection" page as shown by way of example in FIG. 27 and the name of each selectable voice is displayed together with a voice number and a cursor is placed at position of a particular voice designated by the voice number VN (step 51).

Nextly, voice data pointer VOICEF for accessing the voice data memory VDM (FIG. 8) is set at a value corresponding to a current voice number VN (step 52).

Voice mode data is read from a voice data area designated by the voice data pointer VOICEP and set in a voice mode register VMODE. The voice mode register VMODE hence represents the voice mode of the currently selected voice. The element start pointers ESP(1) to ESP(4) are respectively set at values corresponding to four "element parameter data" areas in the voice data area which has been designated by the voice data pointer VOICEP (step 53).

Then, the element type table ETT (FIG. 9) is referred to in accordance with contents of the voice mode register VMODE and the maximum number of tones to be sounded simultaneously (i.e., values of the colum of the maximum number of tones to be simultaneously sounded in the element type table ETT) is thereby determined and stored in a simultaneously soundable tone maximum number register NSCH (step 54).

By operating the data input section 42 or the cursor key CSR (FIG. 7) in a state in which the "voice selection" page as shown in FIG. 27 is displayed in the display section DPY, the voice number VN is thereby changed and a desired voice can be selected.

More specifically, when the data input section 42 is operated in the state in which the "voice selection" page is displayed, "voice selection numerical value input subroutine" EPDS (1) is called in the entry point table EPT (FIG. 11). When the cursor key CSR is operated in the state in which the "voice selection" page is displayed, "voice selection cursor key-on event subroutine" EPCD(1) is called in the entry point table DPT (FIG. 11). The cursor key CSR actually has two types of a vertical cursor and a horizontal cursor and the manner of processing is somewhat different between the two cursors but, for convenience of description, the cursor key CSR will be described as being a single cursor.

Figure 15:
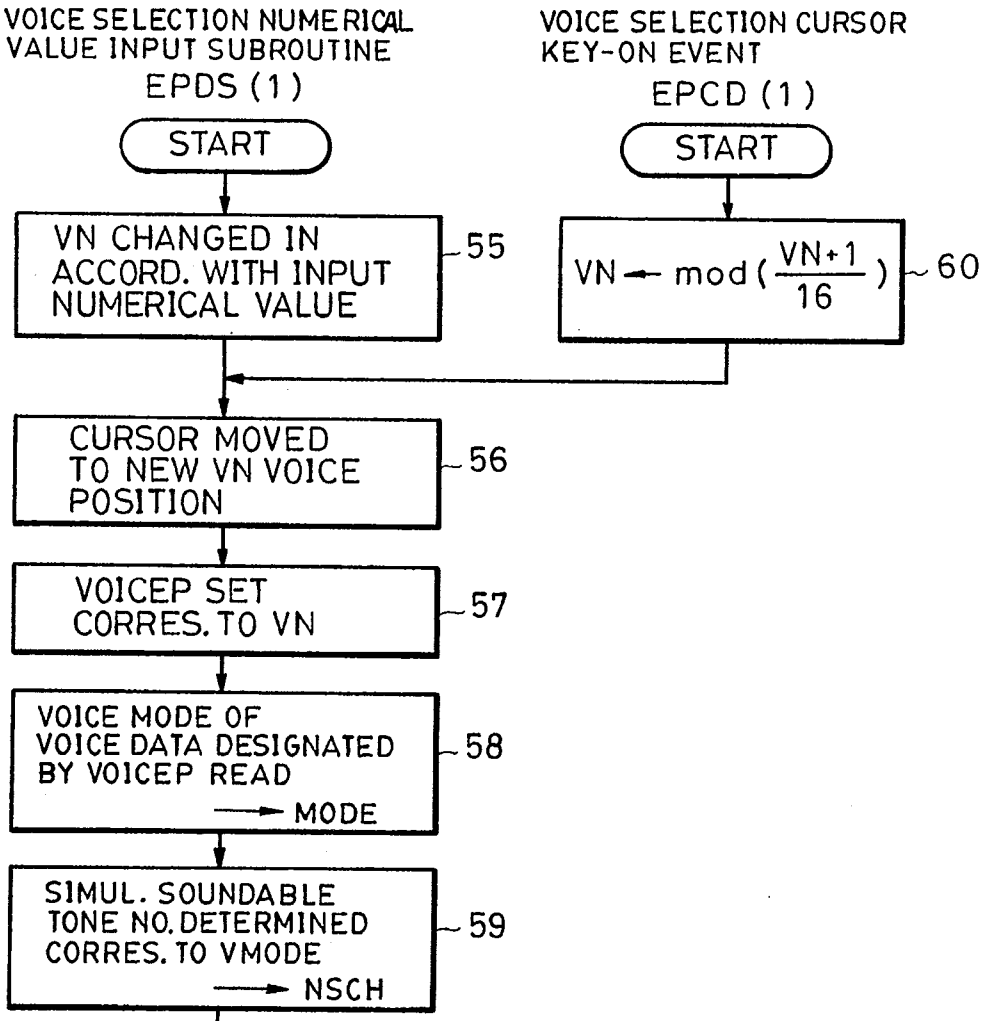

Referring to FIG. 15, the voice selection numerical value input subroutine DPDS(1) and the voice selection cursor key-on event subroutine EPCD(1) will be described. When the data input section 42 has been operated, the voice number VN is changed in accordance with the numerical value which has been input by the data input section 42 (step 55).

Then, the cursor position in the display section DSP is moved to the position of a particular voice designated by a new voice number VN (step 56).

Processing of steps 57, 58 and 59 to be executed nextly is the same as the steps 52, 53 and 54 in FIG. 14, i.e., setting of the voice data pointer VOICEP and element start pointers ESP(1) to ESP(4) corresponding to the new voice number VN, setting of the voice mode VOICE and setting of the simultaneously soundable tone maximum number register NSCH corresponding to the voice mode are executed.

When the cursor key CSR has been depressed, the value of the voice number VN is increased by 1 (step 60). This increase is made at modulo 16. Modulo 16 is selected because the number of selectable voice is 16. Thereafter, the above steps 56 to 59 are executed.

As will be apparent from the above description, the operation of the data input section 42 enables a desired voice number to be input at one time and the operation of the cursor key CSR enables a desired voice number to be input finally by shifting the voice number VN by 1 at each depression of the cursor key CSR.

Introduction to the Editing Processing

In a case where an editing operation for changing or correcting voice data of desired voice data is performed, the "voice selection" page is first called the display section DPY to select a desired voice and thereby set contents of the registers VN, VOICEP, VMODE, NSCH and ESP(1) to ESP(4) to those corresponding to the desired voice. Then, an editing processing can be started by depressing the edit key EDIT (FIG. 7).

Figure 16:
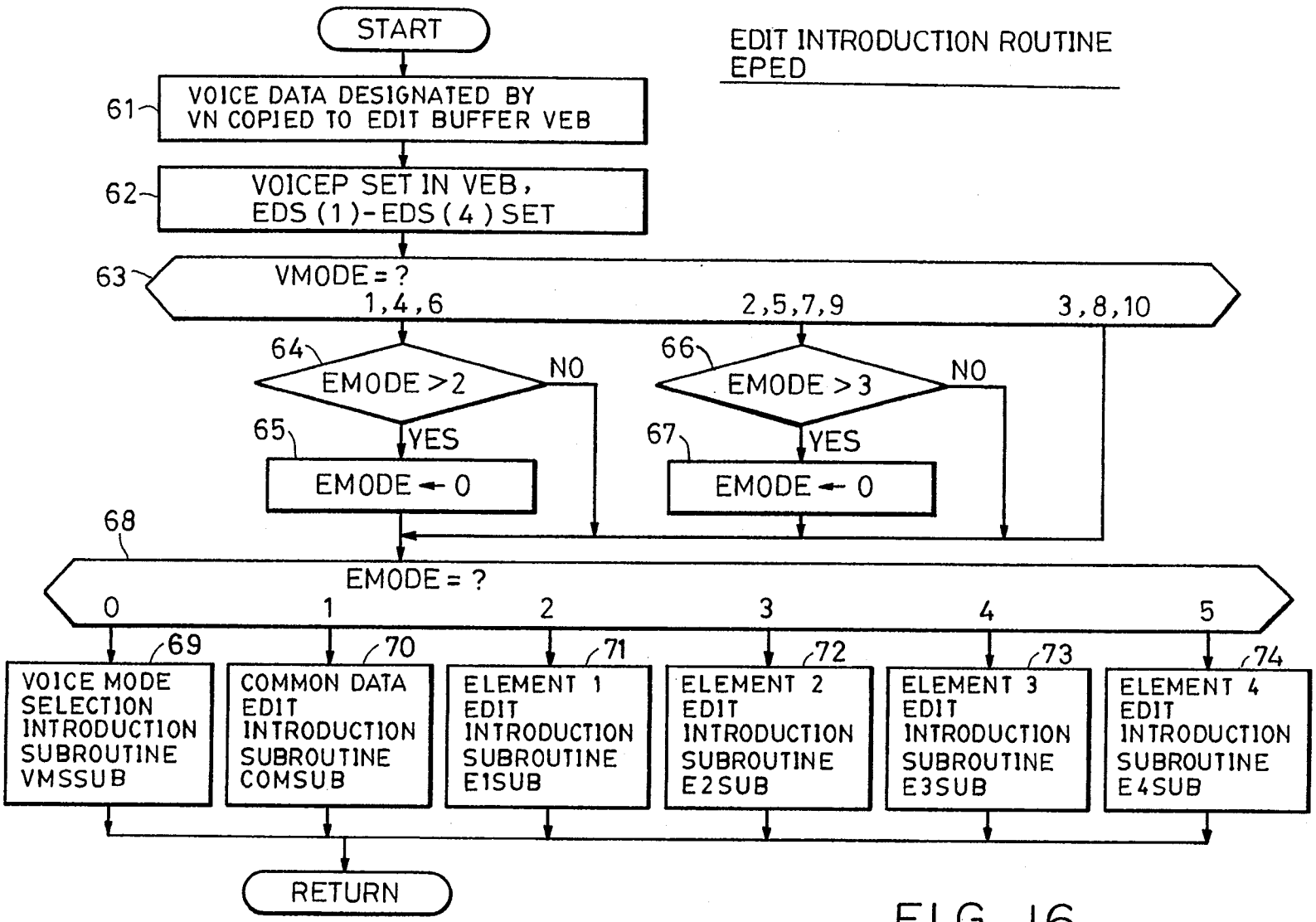

By depressing the edit key EDIT when the picture displayed in the display section DPY is the "voice selection" page, "edit introduction routine" EPED is called in the entry point table EPT (FIG. 11). A specific example of this edit introduction routine EPED is shown in FIG. 16.

In the edit introduction routine EPED, a set of voice data is first read from a voice data area corresponding to the voice number VN and copied to the voice edit buffer VEB (FIG. 8) (step 61). Subsequent editing operations are performed with respect to the vioce data stored in the vioce edit buffer memory VEB. The voice edit buffer memory VEB therefore may be called a buffer exclusively used for editing voice data.

The manner of copying a set of voice data to the voice edit buffer memory VEB has been previously described. That is, "voice name", "voice mode" and "common data" are copied to the common data buffer CDB. Among respective parameter data for four elements at the maximum, those corresponding to the FM tone source are copied, in accordance with their element type, to four FM element buffers 1 to 4 in the FM edit buffer FMEB in the order of its number, and those corresponding to the PCM tone source are copied, in accordance with their element type, to four PCM element edit buffers 1 to 4 of the PCM edit buffer PCMEB in the order of its number. In the remaining FM element edit buffers to which data has not been copied, a predetermined initial value (or reference value) of the "element parameter data" for the FM tone source is stored and, similarly, in the remaining PCM element edit buffers to which data has not been copied, a predetermined initial value (or reference value) for the PCM tone source is stored.

Thereafter, a value of the voice pointer VOICEP is set at the head address of the edit buffer memory VEB and values of the edit start pointers EDS(1) to EDS(4) are set at the head addresses of the element edit buffers which have copied parameter data corresponding to the four elements among the four FM element edit buffers 1 to 4 in the FM edit buffer FMEB and the four PCM element edit buffers 1 to 4 in the PCM edit buffer PCMEB. Accordingly, element edit buffers storing parameter data corresponding to the elements 1 to 4 for the voice under editing among the element edit buffers totalling eight in the FM edit buffer FMEB and the PCM edit buffer PCMEB are designated by the edit start pointers EDS(1) to EDS(4).

Then, vioce mode data is read from the common data buffer CDB and set to the voice mode VMODE and which of the voice modes 1 to 10 (see FIG. 9) this particular voice mode is is examined (step 63).

When contents of the voice mode VMODE represent the voice mode 1, 4 or 6 in which the element 1 only is used, the routine proceeds to step 64 in which whether or not the edit mode EMODE is equal to or larger than 2 is examined.

The edit mode EMODE represents contents of the current editing work and assumes a value from 0 to 5. The relation between this value and contents of editing is as follows:

EMODE=0: selection of the voice mode
EMODE=1: editing of common data
EMODE=2: data editing of the element 1
EMODE=3: data editing of the element 2
EMODE=4: data editing of the element 3
EMODE=5: data editing of the element 4

Accordingly, the edit mode EMODE being equal to or larger than 2 means a mode in which data editing of the element 2, 3 or 4 is performed and this is unnecessary in the voice mode 1, 4 or 6 in which the element 1 only is used. Hence, when the result of step 64 is YES, the routine proceeds to step 65 in which the edit mode EMODE is reset to 0.

When contents of the voice mode VMODE represent the voice mode 2, 5, 7 or 9 in which the elements 1 and 2 only are used, the routine proceeds to step 66 in which whether or not the edit mode EMODE is equal to or larger than 3 is examined. The edit mode being equal to or larger than 3 means a mode in which data editing of the element 3 or 4 is performed, and this is unnecessary in the voice mode 2, 5, 7 or 9 in which the elements 1 and 2 only are used. Hence, when result of step 66 is YES, the routine proceeds to step 67 in which the edit mode EMODE is reset to 0.

When contents of the voice mode VMODE represent the vioce mode 3, 8 or 10 in which all of the elements 1 to 4 are used, the routine proceeds to step 68 without examining the edit mode EMODE.

In step 68, it is examined whether or not the value of the edit mode EMODE is any of 0 to 5 and an edit introduction subroutine (steps 69 to 74) corresponding to the value is executed.

Voice Mode Selection

Figures 17, 18:
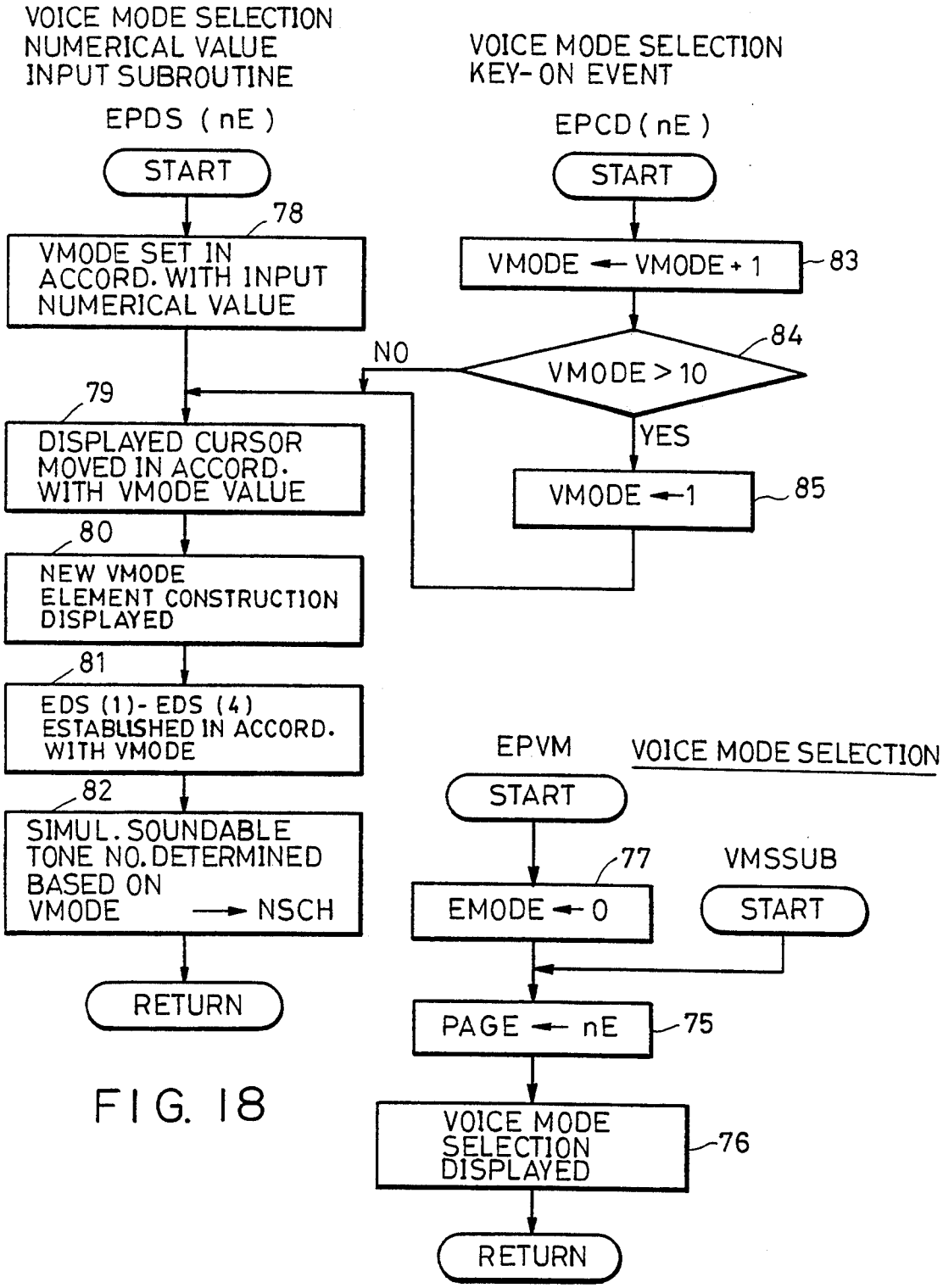

When the value of the edit mode EMODE is 0, a voice mode selection introduction subroutine VMSSUB is executed. An example of this subroutine VMSSUB is shown in FIG. 17.

In step 75, contents of current page PAGE designating a page of the display section DPY are set to a predetermined value nE designating the "voice mode selection" page.

In next step 76, the picture of the display section DPY is set to the "voice mode selection" page as shown in FIG. 28 and information of combinations of the tone source and the system number and information showing difference between a single tone and plural tones in the respective modes 1 to 10 are displayed, the cursor is placed at a position of a particular voice mode designated by the current voice mode VMODE (i.e., the voice mode which is currently selected), and the tone source type of the respective elements 1 to 4 in the currently selected voice mode is displayed in the right upper portion of the display (this latter display is called an element construction display). Besides, as display corresponding to the function switches F1 to F8, "MODE", "cog", "E1", "E2", "E3" and "E4" are displayed whereby it is displayed that the function of the function switches F1 to F5 is set to the edit mode selection function. "MODE" designates the voice mode selection, "coN" designates the common data edit and "E1" to "E4" designate the edit mode in which editing of the element 1 to 4 is made. In this function switch display, the current edit mode (in this example, the voice mode selection MODE) is displayed in a normal way and the other edit modes are displayed in white to indicate that these edit modes can be selected by the operation of the function switches.

The processing for setting the picture of the display section DPY to the "voice mode selection" page as shown in FIG. 28 may be made not by the above described vioce mode selection introduction subroutine VMSSUB but may be made by a voice mode selection subroutine EPVM. That is, in a page of an edit mode other than the voice mode selection page, voice mode selection is assigned to the function switch F1 as described above and, when the function switch F1 has been turned on during display of the page of such edit mode in the display section DPY, the "voice mode selection subroutine" EPVM is called in the entry point table EPT (FIG. 1).

This voice mode selection subroutine EFVM is shown in FIG. 17 together with the voice mode selection introduction subroutine VMSSUB. In step 77, first, the edit mode EMODE is set to "0" designating "voice mode selection" and then the above described steps 75 and 76 are executed.

In this manner, when the data input section 42 or the cursor key CSR is operated in the state wherein the "voice mode selection" page as shown in FIG. 28 is displayed in the display section DPY, the value of the voice mode VMODE is thereby changed and a desired voice mode can be selected.

More specifically, when the data input section 42 is operated in the state wherein the "voice mode selection" page is displayed, "voice mode selection numerical value input subroutine" EPDS(nE) is called in the entry point fable EFT (FIG. 11). When the cursor key CSR is operated in the state wherein the "voice mode selection" page is displayed, "voice mode selection cursor key-on event subroutine" EPCD(nE) is called in the entry point table EFT (FIG. 11).

Referring to FIG. 18, the voice mode selection numerical value input subroutine EFDS(nE) and the voice mode selection cursor key-on event subroutine EPCD(nE) will be described. First, when the data input section 42 has been operated, the voice mode VMODE is changed in accordance with the numerical value input by the data input section 42 (step 78).

Then, the cursor position in the display section DPY is moved to a particular voice mode position designated by a new voice mode VMODE (step 79).

The tone source type of the respective elements 1 to 4 in the new voice mode VMODE is read from the element type table ETT (FIG. 9) in accordance with the new voice mode VMODE and an element construction display corresponding thereto is made in a right upper portion of the display section DPY (step 80).

Then, the values of the edit start pointers EDS(1) to EDS(4) of the respective elements 1 to 4 in the edit buffer memory VEB are reestablished in accordance with the new voice mode VMODE (step 81). This arrangement is made for matching the respective edit start pointers EDS(1) to EDS(4) to the new voice mode VMODE.

Then, the element type table ETT is referred to in accordance with the contents of the new voice mode VMODE and the number of tones to be sounded simultaneously (the value in the column of the number of tones to be sounded simultaneously in the element type table ETT) in the voice mode is determined and stored in a simultaneously soundable number register NSCH (step 82).

When the cursor key CSR has been depressed, the value of the voice mode VMODE is incremented by 1 (step 83). For enabling the value of the voice mode to change within the range from 1 to 10, the value of VMODE is reset to "1" when the value of VMODE which has been incremented by 1 has exceeded 10 (steps 84 and 85). Thereafter, the processing of the above steps 79 to 82 is executed.

As will be apparent from the foregoing description, according to the operation of the data input section 42, a desired voice mode can be selected at one time whereas, according to the operation of the cursor key CSR, by shifting the value of the voice mode VMODE one by one at each depression of the cursor key CSR, a desired voice mode can finally be selected.

Editing of Common Data

Figure 19:
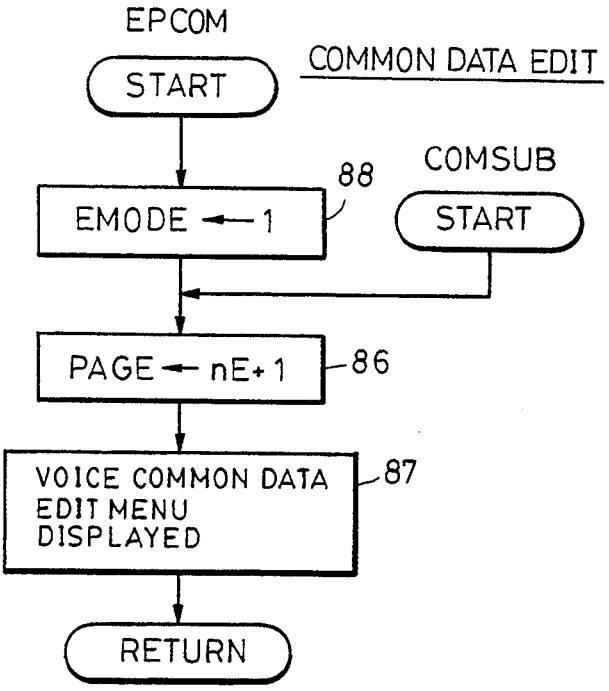

When it has been judged in step 68 of FIG. 16 that the value of the edit mode EMODE is 1, a common data edit introduction subroutine COMSUB is executed. An example of this subroutine is shown in FIG. 19.

First, in step 86, contents of current page PAGE designating the page of the display section DPY are set to a predetermined value nE+1 designating the "common data edit" page.

In next step 87, the picture in the display section DPY is set to "common data edit" menu page as shown in FIG. 29 to display various common data names and the cursor is placed at a currently selected common data name and the tone source type of the elements 1 to 4 in the currently selected voice mode VMODE is displayed at the right upper portion of the display section DPY. In the same manner as described above, display corresponding to the function switches F1 to F5 is made. A function switch corresponding to an element which is not used in the element construction in the currently selected voice mode VMODE is not displayed. In the example of FIG. 29, "E3" and "E4" are not displayed.

The processing for setting the picture in the display section DPY to the "common data edit menu" as shown in FIG. 29 may be made by the common data edit subroutine EPROM instead of using the above described common data edit introduction subroutine COMSUB. More specifically, in a page of an edit mode other than the "common data edit menu", the function of selecting editing of common data is assigned to the function switch F2 as described above and, when the function switch F2 has been turned on during display of the page of one of these edit modes in the display section DPY, the "common data edit subroutine" EPCOM is called in the entry point table EPT (FIG. 11).

This common data edit subroutine EPCOM is shown together with the common data edit introduction subroutine COMSUB in FIG. 19. In this subroutine, the edit mode EMODE is set to "1" showing "common data edit" in step 88 and thereafter the above described steps 86 and 87 are executed.

When the data input section 42 or the cursor key CSR is operated in the s rate wherein the page of the "common data edit" menu as shown in FIG. 29 is displayed in the display DPY, the cursor thereupon is moved and desired common data can be selected. Upon depression of the enter key ENTER (FIG. 7) after selecting desired common data, a lower order subroutine EPET(nE+1) of the "common data edit" is called by referring to the entry point table EPT (FIG. 11) and, in accordance therewith, the page in the display section DPY is changed to a lower order page and change and correction of specific contents of desired common data can thereby be achieved. Description of this lower order subroutine EPET(nE+1) will be omitted.

Data Editing of Each Element

Description will be made here about data editing concerning the element 1 only and description about the other elements 2 to 4 will be omitted since a similar processing is made for these elements.

Figure 20:
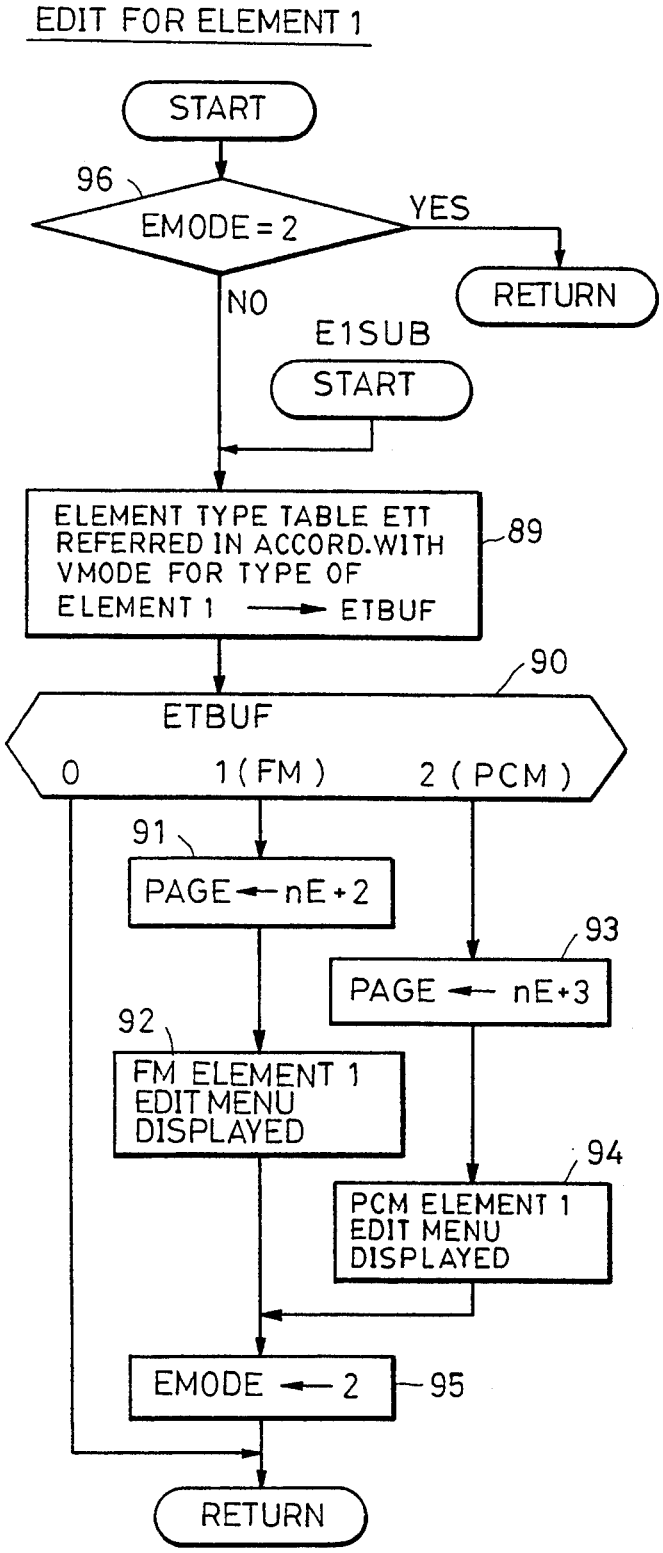
Figure 23:
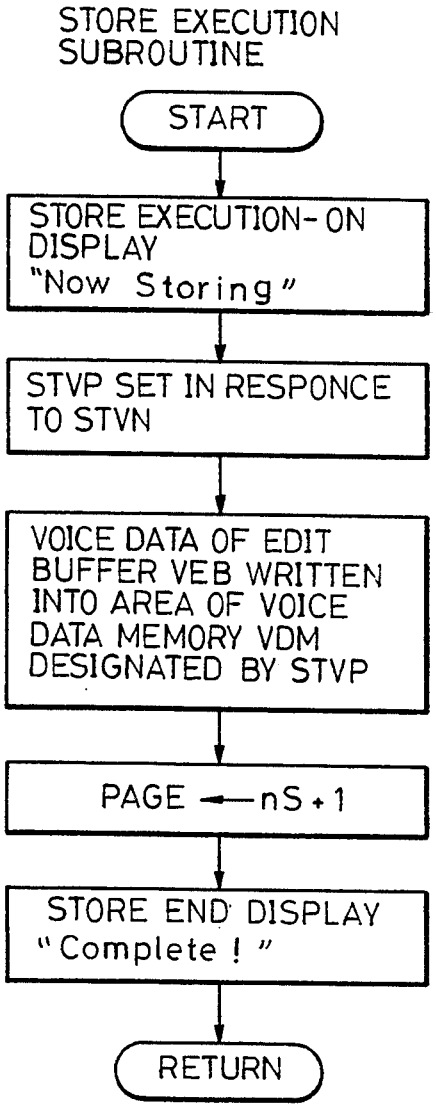

When it has been judged in step 68 of FIG. 16 that the value of the edit mode EMODE is 2, the edit introduction subroutine E1SUB for the element 1 is executed. An example of this subroutine E1SUB is shown in FIG. 20.

In step 89, the element type table ETT is referred to in accordance with the voice mode VMODE and the tone source type of the element 1 is read out and stored in the element type buffer ETBUF.

Nextly, in step 90, the value of the element type buffer ETBUF is examined. If the value is "0", i.e., if this element is not used, this subroutine finishes. If this value is "1", i.e., if this element is of the FM type, the routine proceeds to step 91 in which contents of the current page PAGE designating the page of the display section DPY are set to a predetermined value nE +2 designating "FM data edit" page.

In next step 92, the picture of the display section DPY is set to "FM data edit" menu as shown in FIG. 30 to display various FM parameter data names and the C11FSOF is placed at the currently selected FM parameter data name and the tone source type of the elements 1 to 4 in the currently selected voice mode VMODE is displayed at the right upper portion of the display section DPY. In the same manner as described above, display corresponding to the function switches F1 to F5 is made.

An example of the FM parameters will now be described. Algo is an algorithm parameter setting a combination for connection of the FM operation units OP1 to OP6. OpEG is a parameter for setting an envelope shape for each of the operation units OP1 to OPG. FB PC L is a parameter for setting the feedback level data FL1 to FL6 and external input level control data EXTL1 to EXTL6 (see FIG. 4).

If, on the other hand, the value of the element type buffer ETBUF is "2", i.e. , the PCM type, the routine proceeds to step 93 in which the contents of the current page PAGE designating the page of the display section DPY are set to a predetermined value nE+3 designating "PCM data edit" page.

In next step 94, the picture in the display section DPY is set to "PCM data edit" menu as shown in FIG. 31 to display various PCM parameter data names and the cursor placed at the currently selected PCM parameter data name and the tone source type of the elements 1 to 4 in the currently selected voice mode VMODE is displayed at the right upper portion of the display section DPY. In the same manner as described above, display corresponding to the function switches F1 to F5 is made.

In step 95, the edit mode EMODE is set to "2" designating data editing of the element 1. The setting of this "2" in step 95 is effective when the value of the edit mode EMODE is other than "2".

The processing for setting the picture in the display section DPY to the page of the "FM data edit" menu or the "PCM data edit" menu may be made by the edit subroutine EPE1 of the element 1 instead of by the above described introduction subroutine E1SUB for the element 1. More specifically, in the page of various edit modes, the function of selecting the data editing of the element 1 is assigned to the function switch F3 as described above and, when the function switch F3 has been turned on during display of the page of these edit modes the display section DPY, in the edit subroutine EPE1 for the element 1 is called in the entry point table EPT (FIG. 11).

The edit subroutine EPE1 for the element 1 is shown together with the element 1 introduction subroutine E1SUB in FIG. 20. In this subroutine, it is examined whether or not the edit mode EMODE has already been set to "2" designating "edit of the element 1" and, if result is YES, the processing returns without further executing this subroutine. If the result is NO, it means change from another edit mode to the edit mode for the element 1 and, in this case, the above described steps 89 to 95 are executed.

When the data input section 42 or the cursor key CSR is operated in the state wherein the page of the "FM data edit" menu or the "PCM data edit" menu shown in FIG. 30 or 31 is displayed in the display section DPY in the foregoing manner, the cursor is thereby moved and desired parameter data can be selected. Upon depression of the enter key ENTER <FIG. 7) after selecting desired parameter data, the lower order subroutine EPET(nE+2) or EPET(nE+3) of the "FM data edit" menu or the "PCM data edit" menu is called by referring to the entry point table EPT (FIG. 11) and, in accordance therewith, the page of the display section DPY is changed to a lower order page and change and correction of specific contents of desired FM or PCM parameter data can thereby be achieved. Description of this lower order subroutine EPET (nE+2) or EPET (nE+3) will be omitted.

An example of change or correction of specific contents of FM parameter data will be described. If the edit of parameter FB PC L of No. 9 is selected (i.e., the enter key ENTER is depressed after positioning the cursor at No. 9) in the "FM data edit" menu of FIG. 30, the display section DPY is changed to the page of the feedback and PCM level edit as shown in FIG. 32. In this page, the cursor key CSR or the data input section 42 is operated suitably to set the feedback level and the PCM level at desired values with respect to each of the operation units OF1 to OP6 of the FM tone source 18. The feedback level is, as described above, level data for setting the ratio of output of the same operation unit fed back as a self-modulating wave signal and this corresponds to the feedback level data FL1 to FL6 in FIG. 4. The PCM level is level data for setting the ratio of the output tone signal of the PCM tone source 17 applied to the respective operation units OF1 to OP6 of the FM tone source 18 as a modulating wave signal and this corresponds to the external input level control data EXTL1 to EXTL6. As described above, in a case where the feedback or the PCM modulating wave signal is not used, the values of these level data are set to "0"

The above is the description of data editing concerning the element 1. Data editing concerning the other elements 2 to 4 can also be made in steps similar to the above described steps.

More specifically, when it has been judged in step 68 of FIG. 16 that the value of the edit mode EMODE is 3, an edit introduction subroutine E2SUB for the element 2 is executed (step 72) and, when the edit mode EMODE is 4, an edit introduction subroutine E3SUB for the element 3 is executed (step 73). Likewise, when the edit mode EMODE is 5, an edit introduction subroutine E4SUB for the element 4 is made (step 74). By turning on one of the function switches F4 to F6 when the page of the edit mode is displayed in the display section DPY, "edit subroutine" of the corresponding elements 2 to 4 is called in the entry point table EPT and this edit subroutine is executed.

Store Processing

Upon completion of a desired edit, the store key STORE (FIG. 7) is depressed to bring about a mode in which the edited voice data is restored from the voice edit buffer memory VEB to the voice data memory VDM.

Figure 21:
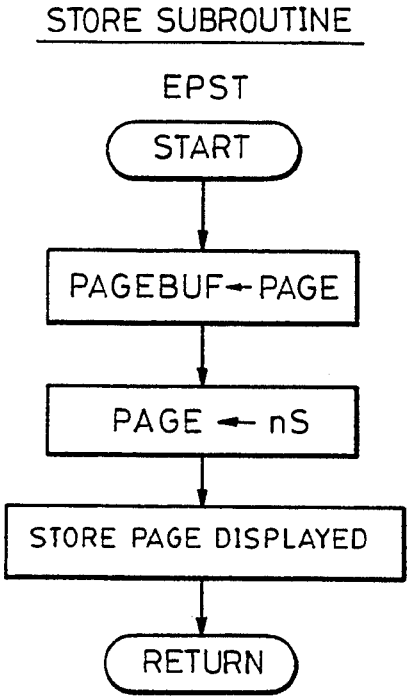

When the store key STORE is depressed in a state wherein the picture in the display section DPY is a page of some edit mode, "store subroutine" is called in the entry point table EFT (FIG. 11). A specific example of this store subroutine EPST is shown in FIG. 21.

In the store subroutine EPST, page data of current page PAGE is transferred to the page buffer PAGEBUF and contents of the current page PAGE are set to a predetermined value nS designating "store" page. The page buffer PAGEBUF is provided for returning the picture to the original page during or after the store processing. Then, the picture of the display section DPY is set to the "store" page as shown in FIG. 33 to display the current voice number and voice name and also voice names corresponding to respective voice numbers and the cursor is placed at a position of the voice number designated by a store voice number STVN. A display of quit key QUIT is also made in correspondence to the function switch F1 and a display of a start key START is made in correspondence to the function switch F8.

When the data input section 42 or the cursor key CSR is operated in the state wherein the "Store" page as shown in FIG. 33 is displayed in the display section DPY, the value of the store voice number STVN is changed in accordance therewith and a desired voice number at which the edited voice data is to be stored can be selected.

More specifically, when the data input section 42 has been operated in the state wherein the "store" page is displayed, "store voice number numerical value input subroutine" EPDS(nS) is called in the entry point table EFT. When the cursor key CSR has been operated in the state wherein the "store" page is displayed, "cursor key-on event subroutine" EPCD(nS) is called in the entry point table EPT (FIG. 11).

Figure 22:
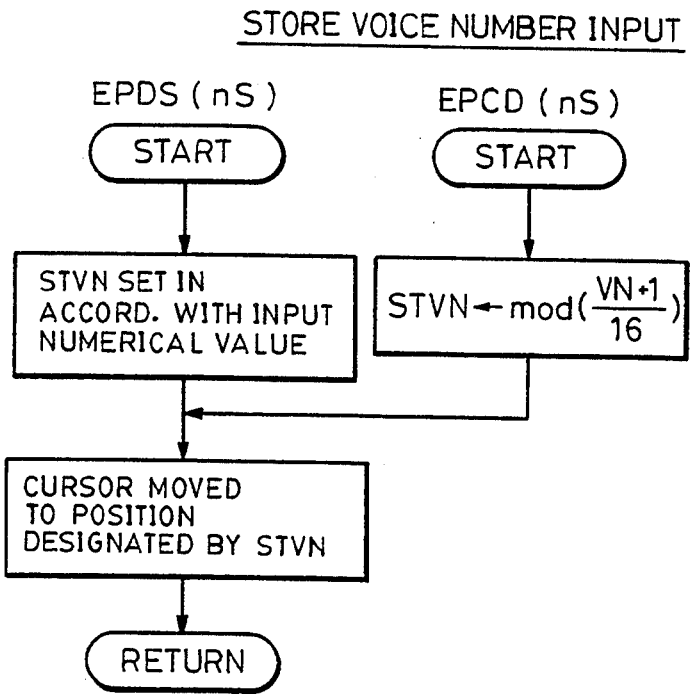

Referring to FIG. 22, the store voice number numerical value subroutine EPDS (nS) and the cursor key-on event subroutine EPCD(nS) will be described. First, when the data input section 42 has been operated, the value of the store voice number STVN is changed in accordance with the numerical value having been input by the data input section 42. Then, the cursor in the display section DPY is moved to a position of a specific voice number designated by a new store voice number STVN. When the cursor key CSR has been depressed, the value of the store voice number STVN is increased by 1 at modulo 16 and then the cursor in the display section DPY is moved to a position of a specific voice number designated by a new store voice number STVN.

In this manner, after registering, in the store voice number, a desired voice number at which the edited voice data is to be stored, the start key STRT (i.e., the function switch F8) is turned on. "Store execution subroutine" shown in FIG. 23 thereupon is called in the entry point table EPT. In this case, a display such as "Now Storing" indicating that storing is being executed is made in a lower portion of the picture of the "store" page. Then, a store voice pointer STVP is set in response to the store voice number STVN. This store voice pointer STVP designates a head address of a voice data area in the voice data memory VDM corresponding to the voice number of STVN.

Then, data of the voice edit buffer memory VEB is transferred to the voice data area in the voice memory VDM designated by the store voice pointer STVP. In this case, all of the data of the voice edit buffer memory VEB is not transferred but necessary data only is transferred in accordance with the contents of the voice mode VMODE. First, "voice name", "voice mode" and "common data" in the common data buffer CDB are transferred to a corresponding area in the voice area in the voice memory VDM. Then, data among the four FM element edit buffers 1 to 4 in the FM edit buffer FMEB and the four PCM element edit buffers 1 to 4 in the PCM edit buffer PCMEB which are necessary in accordance with the contents of the voice mode VMODE only are transferred to a corresponding element parameter data area of the voice data area in the voice memory VDM.

Thereafter, contents of the current page PAGE are changed to next page ns+1 and a predetermined store end display (e.g., "Complete !" is displayed in the lower portion of the picture) is made.

Figure 24:
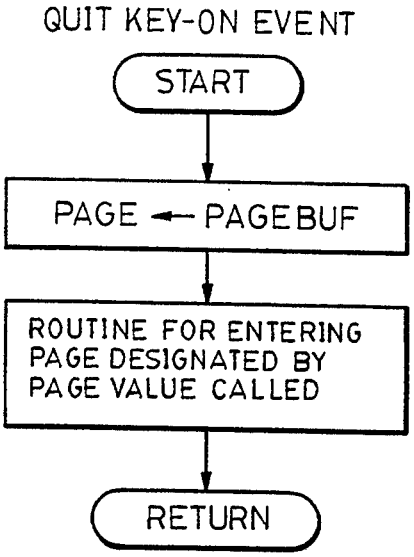

In the "store" page of the page number ns or the "store end" page of the page number nS+1, the function switch F1 functions as the quit key QUIT. When this switch has been turned on, a quit key-on event subroutine shown in FIG. 24 is executed. In this subroutine, page data of a page buffer PAGEBUF is transferred to the current page PAGE and a routine for entering a page designated by the current page PAGE is called. By this arrangement, when the quit key QUIT has been turned on during or after the store processing, the picture of the display section DPY is restored to a page immediately before entering the store processing. Editing thereby may be performed again.

Key-assigning Processing

When a new key has been depressed, a key-on event shown in FIG. 25 is executed in which generation of a tone of the depressed key is assigned to one or more channels.

First, the key code of the depressed key relating to the key-on event is stored in the key code register KCODE and touch data corresponding thereto is stored in a touch data register TDATA (step 100).

Nextly, a primary assignment channel ASCH is determined on the basis of the simultaneously soundable tone number registered in the simultaneous soundable tone number register NSCH and the newly depressed key is assigned to this primary assignment channel ASCH (step 101).

The primary assignment channel ASCH is not an actual tone generation channel but a channel used in a stage prior to assigning actual tone generation. The number of the primary assignment channel ASCH corresponds to the simultaneously soundable tone number. In a case where a tone of the same key is sounded in plural channels, the same key is assigned to plural channels in actual tone generation channels. In the case of the primary assignment channel ASCH, the same key is assigned only to one channel. An example of relation among the simultaneously soundable tone number NSCH, actual tone generation channels and the primary assignment channel ASCH will be described below. The actual tone generation channels are designated by numbers 0 to 15 and the respective primary assignment channel s ASCH are designated by numbers 0 to 15.

When the simultaneously soundable tone number NSCH=1:

The primary assignment channel ASCH is "0" only.

As to the actual tone generation channels, any of "0" to "3" are used depending upon the number of systems (i.e., the number of the elements used). The same key is assigned to the respective tone generation channels.

When the simultaneously soundable tone number NSCH=4

The primary assignment channels ASCH are "0" to "4" totalling four.

As to the actual tone generation channels, four groups which are a group of "0" to "3", a group of "4" to "7" , a group of "8" to "11" and a group of "12" to "15" are used. Different keys are assigned to the respective groups. In the channels of the same group, the same key is assigned depending upon the number of systems (the number of the elements used). If, for example, only one element is used, the depressed key is assigned to one channel only in the same group whereas, if two elements are used, the same depressed key is assigned to two channels in the same group.

When the simultaneously soundable tone number NSCH=8:

The primary assignment channels ASCH are "0" to "7" totalling 8.

As to the actual tone generation channels, eight groups which are a group of "0" and "1", a group of "2" and "3", a group of "4" and "5", a group of "6" and "7", a group of "8" and "9", a group of "10" and "11", a group of "12" and "13" and a group of "14" and "15" are used. Different keys are assigned to the respective groups. In the channels of the same group, the same key is assigned depending upon the number of systems (the number of the elements used).

When the simultaneously soundable tone number=16:

The primary assignment channels ASCH are "0" to "15" totalling sixteen.

As to the actual tone generation channels, channels "0" to "15" are separately used. Different keys are assigned to the respective tone generation channels. The number of systems (the number of the elements used) is 1.

In step 101, a newly depressed key is provisionally assigned to any of the primary assignment channels ASCH determined in the foregoing manner depending upon the simultaneously soundable tone number NSCH. In the following description, the reference characters ASCH is described as data specifying the number of one primary assignment channel about which the provisional assignment has been determined.

In next step 102, whether or not the provisional assignment has been determined in the preceding step 101 is examined. When, for example, keys of a larger number than the simultaneously soundable tone number have been depressed simultaneously, a provisional assignment is sometimes not made in step 101 and, in this case, result in step 102 becomes NO. If the provisional assignment has been determined, result in step 102 is YES and the routine proceeds to step 103.

In step 104, a tone source type of an i-th element concerning the currently selected voice is read from the element type table ETT and registered in the element type buffer ETBUF.

In step 105, an actual channel to which generation of a tone signal concerning the i-th element is to be assigned is determined and the number of the determined channel is registered in a channel buffer CHBUF. This channel is determined by an actual channel assignment routine as shown in FIG. 26 on the basis of the voice mode VMODE of the currently selected voice and the primary assignment channel ASCH of which the provisional assignment has been determined in step 101. This routine will be described more fully later.

In next step 106, which of 0, 1 and 2 the type of the i-th element stored in the element type buffer ETBUF is is examined. If result is "1" indicating the FM tone source, the routine proceeds to step 107 in which parameter data and common data of the i-th element, key code and touch data in KCODE and TDATA and the key-on signal representing key-on are provided to a channel designated by the channel buffer CHBUF in the FM tone source 18. If the element type is "2" indicating the PCM tone source, the routine proceeds to step 108 in which parameter data and common data of the i-th element, key code and touch data in KCODE and TDATA and the key-on signal KON representing key-on are provided to a channel designated by the channel buffer CHBUF in the PCM tone source 17.

After step 107 or 108, the routine proceeds to step 109. On the other hand, if the type of the i-th element is "0" indicating non-use, the routine proceeds to step 109 without performing supply of data to a channel in the tone generator as in step 107 or 108.

In step 109, whether or not i is 4 or over 4 is examined. If result is NO, the routine proceeds to step 110 in which the routine returns to step 104 after increasing i by 1 and the routine of steps 104 to 109 is repeated. That is, the processing for determining a channel to which generation of a tone signal should be assigned is made. When i is 4 or over 4, this key-on event processing is finished.

Description will be made about the actual assignment routine of FIG. 26. In step 111, which of 1 to 10 the voice mode VMODE is is examined.

When the voice mode VMODE is voice mode 1, 2 or 3 in which the simultaneously soundable tone number NSCH is 1, the routine proceeeds to step 112 in which a channel corresponding to a value of $i-1$ is determined as the actual assignment channel and registered in the channel buffer CHBUF. Hence, the same key is sequentially assigned to channels "0" to "3" such that the key is assigned to $i=1-1=0$ channel when $i=1$ and it is assigned to $i=2-1=1$ channel when $i=2$. As to an element which is not used, the data supply processing as in step 107 or 108 is not made so that the situation is the same as in the case where assignment substantially is not made.

When the simultaneously soundable tone number NSCH is 8 and the voice mode VMODE is voice mode 5 or 7 in which a single type of tone source is used, the routine proceeds to step 113 in which a channel corresponding to result of operation of $2\times ASCH+i-1$ is determined as the actual assignment channel and registered in the channel buffer CHBUF. When, therefore, a certain key has been provisionally assigned to ASCH=0, the same key is assigned to channels of "0" and "1" such that the key is assigned to a channel corresponding to result of operation "0" when $i=1$ and the key is assigned to a channel corresponding to result of operation "1" when =2. When a certain key has been provisionally assigned to ASCH=1, the same key is assigned to channels of "2" and "3" such that the key is assigned to a channel corresponding to result of operation "2" when $i=1$ and the key is assigned to a channel corresponding to result of operation "3" when $i=2$.

In the case of the voice mode 8 in which the simultaneously soundable tone number NSCH is 4, the routine proceeds to step 114 in which a channel corresponding to result of operation of $4\times ASCH+i-1$ is determined as the actual assignment channel and is registered in the channel buffer CHBUF. Hence, when a certain key has been provisionally assigned to a channel ASCH=0, the same key is assigned sequentially to channels "0" to "3" such that the key is assigned to a channel corresponding to result of operation "when $i=0$, the key is assigned to a channel corresponding to result of operation "2" when $i=3$ and the key is assigned to a channel corresponding to result of operation "3" when $i=4$. Likewise, when another key has been provisionally assigned to a channel ASCH=1, the same key is sequentially assigned to channels "4" to "7" such that the key is assigned to a channel corresponding to result of operation "4" when $i=2$ and the key is assigned to a channel corresponding to result of operation "5" when $i=2$.

In the case of voice mode 4, 6 or 9 in which the simultaneously soundable tone number NSCH is 16, the routine proceeds to step 115 in which the value of the primary assignment channel ASCH is used directly as the actual assignment channel and is registered in the channel buffer CHBUF. Hence, when a certain key has been provisionally assigned to ASCH=0, this key is assigned to the actual assignment channel "0" regardless of the value of i. Accordingly, in the case of voice 9 in which two types of tone sources are used, when a certain key has been provisionally assigned to ASCH=0, a tone signal of the element 1 corresponding to the FM tone source is assigned to the channel "0" of the FM tone source and a tone signal of the element 2 corresponding to the PCM tone source is assigned to the same channel "0" of the PCM tone source. In this manner, the same key is assigned to the same channel of different tone sources.

In the case of voice mode 10 in whcih the simultaneously soundable tone number is 8 and two types of tone sources are used, the routine proceeds to step 116 in which a channel corresponding to result of operation $2\times ASCH+mod[(i-1)/2]$ is determined as the actual assignment channel and is registered in the channel buffer CHBUF. Hence, when a certain key has been provisionally assigned to ASCH=0, tone signals of the elements 1 and 2 corresponding to the FM tone source are assigned to "0" and "1" of the FM tone source and the tone signals of the elements 3 and 4 corresponding to the PCM tone source are assigned to the same channels "0" and "1" of the PCM tone source such that a tone signal is assigned to a channel corresponding to result of operation "0" since mod[(i−1)/2]=0 when i=1, a tone signal is assigned to a channel corresponding to result of operation "1" since mod[(i−1)/2]=1 when i =2,] a tone signal is assigned to a channel corresponding to result of operation "0" since mod[-(i−1)/2]=0 when i=3, a tone signal is assigned to a channel corresponding to result of operation "1" since mod[(i−1)/2]=1 when i=4. When another key has been provisionally assigned to ASCH=1, tone signals of the elements 1 and 2 corresponding to the FM tone source are assigned to the channels "2" and "3" of the FM tone source and tone signals of the elements 3 and 4 corresponding to the PCM tone source are assigned to the same channels "2" and "3" of the PCM tone source.

Modified Embodiments

The type of the tone source is not limited to PCM and FM but any other tone source may be used. For example, as the modulation operation type tone source, tone sources using amplitude modulation operation (AM) and window function operation are known besides the tone source using FM and these tone sources may also be used. Also, tone sources based on harmonics synthesis system or reduced or subtraction system using filters may be employed. It is preferable that the tone generation system of the first tone source is different from that of the second tone source. In a case where the tone generation system of the same operation principle is used, it is preferable that the tone generation system in each tone source can form a tone peculiar to the tone source. It is also possible to adopt a combination in which one of the first and second tone source sections uses the FM tone source and the other uses the AM tone source.

In the above described embodiment, the system number (i.e., element number) is automatically determined by the voice mode of a selected voice. Referring, for example, to FIG. 9, in the voice mode 5, the system number "a" of the FM tone source is 2 and the system number "b" of the PCM tone source is 0. In the voice mode 7, the system number "a" of the FM tone source is 0 and the system number "b" of the PCM tone source is 2. In the voice mode 10, the system number "a" of the FM tone source is 2 and the system number "b" of the PCM tone source is 2. Alternatively, however, the system numbers of the respective tone sources may be individually set as desired by the player instead of determining them automatically. By way of example, a table similar to the element type table ETT in FIG. 9 may be formulated as desired by the player.

The channels in the respective tone sources are not limited to the time division type channels but may be of a parallel channel type.

Voice which can be generated simultaneously is not limited to one but plural voices may be generated. In this case, channel assignment may conveniently be made by DVA (dynamic voice allocation).

In a voice mode in which only one tone source can be used, the other tone source which is not used may be used for other purposes. For example, a tone corresponding to performance information provided from a sequencer or an external source may be generated in the unused tone source. The unused tone source may also be used in such a manner that, when channels of the tone source which is being used are all busy, overflowing tones are generated provisionally in the unused tone source.

For simultaneously generating output tone signals of two tone sources, the mixing circuit 23 is provided and output tone signals of the two tone sources are added (or subtracted) in an electric circuit in the above described embodiment. Alternatively, the output tone signals of the two tone sources may be controlled in their tone generation level and then sounded from separate loudspeakers and added and combined in space.

As described in the foregoing, according to the invention, the output tone signal of the first tone source section can be used as a modulating signal as required in the second tone source section and the range of forming a tone by the modulation operation can thereby be broadened. Moreover, by performing a control for simultaneously generating the output tone signals of the first and second tone source sections, diversified and wide-range tone forming can be realized by suitably combining the outputs of the two tone source sections ranging from a tone color peculiar to the first tone source section to a tone color peculiar to the second tone source sectio.

According to the invention, single complex tone color can be composed of plural element tone colors and which tone source section should generate a partial tone signal corresponding to each of the element tone colors can be individually designated by the element type information. Therefore, a single complex tone color can be formed by actively utilizing tone source sections made of different tone source systems in various combinations whereby the range of tone forming can be broadened and forming of a more complex and diversified tone can be realized.

Further, according to the invention, change or setting of contents of the parameter information with respect to one of the element tone colors of the single complex tone color can be designated and an automatic control is made so that, responsive to the element type information concerning the designated element tone color, change or setting of contents of the parameter information adapted to the tone generation system of the respective tone source sections can be made. Therefore, in editing tone color data, it is not necessary to designate each time which element tone color should be made by which tone source system, so that the editing work can be made more effectively.

Further, according to the invention, tone color data of a desired single complex tone color about which editing should be made is stored from the data memory to the edit memory section and data editing such as change and setting is applied to the tone color data stored in the edit memory section. This enables the device to cope with increase in the data amount by providing a spare memory capacity in the edit memory section, so that degree of freedom in data editing is improved.

Further, according to the invention, by adopting the construction in which tone source-system number combination information consisting of information specifying respectively number "a" of tone signals to be generated simultaneously in correspondence to common tone generation designation information in the first tone source section and number "b" of tone signals to be generated simultaneously in correspondence to the common tone generation designation information in the second tone source section, these numbers "a" and "b" can be freely designated. Moreover, by enabling a proper assigning processing to be made in accordance with such freely designated numbers "a" and "b", two different tone sources can be actively utilized in various combinations and forming of a complex and diversified tone can be realized.

What is claimed is:

1. A tone signal generation device comprising:

first tone source means for generating a first tone signal in response to tone generation designation information;

second tone source means, including a modulating signal input, for generating a second tone signal by executing a predetermined modulation operation in response to tone generation designation information, wherein said first and second tone source means employ different tone forming systems;

tone color parameter generating means for generating, separately for said first and second tone source means, respectively, tone color parameters adapted for the specific tone forming system employed in said respective tone source means;

modulating signal introduction control means for receiving said first tone signal and controlling introduction of said first tone signal to the modulating signal input of said second tone source means; and tone generation control means for controlling the simultaneous generation of said first and second tone signals.

2. A tone signal generation device as defined in claim 1 wherein said modulating signal introduction control means controls the level of said first tone signal introduced to the modulating signal input of said second tone source means.

3. A tone signal generation device as defined in claim 2 wherein said second tone source means synthesizes a tone signal by a predetermined modulation operation including plural modulation operation terms which make up a modulation operation algorithm, and said modulating signal introduction control means controls the level of said first tone signal introduced to the modulating signal input to said second tone source means separately with respect to each term of the plural modulation operation terms.

4. A tone signal generation device as defined in claim 1 wherein said tone generation control means controls the levels of the first and second tone signals of said first and second tone source means, respectively, and thereby controls a mixing ratio of said first and second tone signals in generating these tone signals simultaneously.

5. A tone signal generation device as defined in claim 1 wherein said second tone source means generates said second tone signal by a frequency modulation operation.

6. A tone generation device comprising:

plural tone source means for forming plural tone signals by tone generation systems which are different from one another;

tone color parameter generation means for generating element type information designating, with respect to each of the element tone colors which are combined together to form the complex tone color, which tone source means should generate a partial tone signal corresponding to each of said element tone colors, and parameter information for each of said element tone colors, wherein said parameter information is employed for the specific tone generation system in the respective one of the plural source means; and distribution means for distributing, responsive to the element type information for each element tone color, the parameter information corresponding to the element tone color to said tone source means designated by the element type information, said respective tone source means generating partial tone signals each having an element tone color corresponding to the distributed parameter information and a tone signal corresponding to the complex tone color being generated by combining these partial tone signals;

edit designation means for designating a change in, or setting of, the parameter information with respect to one of the element tone colors of the single complex tone color; and edit control means for controlling, responsive to the element type information concerning the element tone color designated by said edit designation means, the change or setting of the parameter information adapted to the tone generation system of said respective tone source means.

7. A tone signal generation device comprising:

plural tone source means for forming plural tone signals by tone generation systems which are different from one another;

tone color parameter generation means for generating element type information designating, with respect to each of the element tone colors which are combined together to form the complex tone color, which tone source means should generate a partial tone signal corresponding to each of said element tone colors, and parameter information for each of said element tone colors, wherein said parameter information is employed for the specific tone generation system in the respective one of the plural source means; and distribution means for distributing, responsive to the element type information for each element tone color, the parameter information corresponding to the element tone color to said tone source means designated by the element type information, said respective tone source means generating partial tone signals each having an element tone color corresponding to the distributed parameter information and a tone signal corresponding to the complex tone color being generated by combining these partial tone signals;

wherein said tone color parameter generation means comprises a data memory which stores tone color data containing the parameter information and the element type information for each of a plurality of the complex tone colors;

edit designation means for selecting one of the complex tone colors and designating change or setting of contents of the tone color data of the selected complex tone color;

edit memory means for reading the tone color data concerning the complex tone color designated by said edit designation means from said data memory and storing the tone color data; and edit execution means for applying change or setting to the tone color data stored in said edit memory means.

8. A tone signal generation device as defined in claim 7 wherein said edit memory means has a capacity capable of storing the parameter information for a larger number of element tone colors than a maximum number of element tone colors which constitute a single complex tone color.

9. A tone signal generation device as defined in claim 8 wherein said edit memory means has plural memory areas equal in number to the number of said tone source means, each of said plural memory areas being capable of storing the parameter information concerning element tone colors of a number equal to the maximum number of the element tone colors which constitute the single complex tone color.

10. A tone signal generation device comprising:

first tone source means, employing a first tone generation system, for generating tone signals in N channels;

second tone source means for generating tone signals in M channels, said second tone source means employing a second tone generation system different from the first tone generation system of said first tone source means;

tone source-system number combination information generation means for generating tone source-system number combination information comprising information specifying, respectively, the number "a" of tone signals to be generated simultaneously in correspondence to common tone generation designation information in said first tone source means and the number "b" of tone signals to be generated simultaneously in correspondence to the common tone generation designation information in said second tone source means; and assigning means, responsive to said tone generation designation information and the tone source-system number combination information, for assigning generation of tone signals corresponding to the tone generation designation information to the "a" channels among the N channels in said first tone source means and assigning generation of tone signals corresponding to the tone generation designation information to the "b" channels among the M channels in said second tone source means, wherein tone signals are generated in the respective channels of said respective tone source means in accordance with these assignments.

11. A tone signal generation device as defined in claim 10 wherein said tone source-system number combination information generation means comprises means for selecting one mode from among plural modes corresponding to combinations of the numbers "a" and "b" and generates information representing the selected mode as the tone source-system number combination information.

12. A tone signal generation device as defined in claim 10 wherein said tone source-system number combination information generation means comprises means for freely designating the numbers "a" and "b" separately and generates information designating the numbers "a" and "b" separately as the tone source-system number combination information.

13. A tone signal generation device comprising:

first tone source means for generating tone signal in N channels;

second tone source means for generating tone signal in M channels, said second tone source means employing a second tone generation system different from the first tone generation system of said first tone source means;

tone source-system number combination information generation means for generating tone source-system number combination information comprising information specifying, respectively, the number "a" of tone signals to be generated simultaneously in correspondence to common tone generation designation information in said first tone source means and the number "b" of tone signals to be generated simultaneously in correspondence to the common tone generation designation information in said second tone source means; and assigning means, responsive to said tone generation designation information and the tone source-system number combination information, for assigning generation of tone signals corresponding to the tone generation designation information to the "a" channels among the N channels in said first tone source means and assigning generation of tone signals corresponding to the tone generation designation information to the "b" channels among the m channels in said second tone source means, wherein said assigning means determines simultaneously soundable tone numbers corresponding to the different tone generation designation information in said respective tone source means on the basis of the channel numbers N and M and the numbers "a" and "b" and performs assignment in accordance with the determined simultaneously soundable tone numbers;

wherein tone signals are generated in the respective channels of said respective tone source means in accordance with these assignments.

14. A tone signal generation device as defined in claim 10 which further comprises tone color selection means and wherein said tone source-system number combination information generation means generates, in response to a tone color selected by said tone color selection means, information specifying the numbers "a" and "b" in accordance with the prepared tone color as the tone source-system number combination information.

15. A tone signal generation means defined in claim 14 wherein said tone source-system number combination information generation means comprises means for specifying one voice mode among plural voice modes corresponding to combinations of the numbers "a" and "b" in accordance with the tone color selected by said tone color selection means and generates information representing the specified voice mode as the tone source-system number combination information.

16. A tone signal generation device as defined in claim 14 wherein a tone corresponding to one tone color comprises one or more tone signal elements and the numbers "a" and "b" are substantially specified by designating which of said first and second tone source means should generate these tone signal elements.

* * * * *